US009340962B2

(12) United States Patent
Tanimoto et al.

(10) Patent No.: US 9,340,962 B2
(45) Date of Patent: May 17, 2016

(54) OPERATING DEVICE FOR FLUSH WATER TANK ASSEMBLY

(71) Applicant: TOTO LTD., Fukuoka (JP)

(72) Inventors: Hideki Tanimoto, Kitakyushu (JP); Koki Shinohara, Kitakyushu (JP); Kenji Hatama, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 184 days.

(21) Appl. No.: 14/221,073

(22) Filed: Mar. 20, 2014

(65) Prior Publication Data

US 2014/0289946 A1 Oct. 2, 2014

(30) Foreign Application Priority Data

Mar. 28, 2013 (JP) ..... 2013-068956

(51) Int. Cl.
*E03D 5/094* (2006.01)

(52) U.S. Cl.
CPC ..... *E03D 5/094* (2013.01)

(58) Field of Classification Search
CPC ..... E03D 5/094; E03D 5/09; E03D 5/00; E03D 5/02; E03D 5/028
USPC ..... 4/405, 411, 412, 413, 414
See application file for complete search history.

(56) References Cited

U.S. PATENT DOCUMENTS

2012/0233759 A1* 9/2012 Huang ..... E03D 5/092 4/324

* cited by examiner

*Primary Examiner* — Janie Loeppke
(74) *Attorney, Agent, or Firm* — Studebaker & Brackett PC

(57) ABSTRACT

An operating device of the present invention includes: an operating member configured to be rotationally moved according to a rotational operation performed by a user; a rotary shaft; and a drive unit disposed above a level of flush water within a flush water tank, and configured to displace a coupling member according to a rotational movement of the rotary shaft, the coupling member coupling the drive unit and a water discharge valve together, and capable of opening and closing the water discharge valve by means of its own displacement, wherein the drive unit comprises a rotation mechanism configured to be rotated at a radius of rotation greater than that of the rotary shaft, the drive unit being operable to roll up the coupling member along its own rotational direction.

10 Claims, 17 Drawing Sheets

OPERATING DEVICE FOR FLUSH WATER TANK ASSEMBLY

TECHNICAL FIELD

The present invention relates to an operating device for a flush water tank assembly, and, more particularly, to an operating device for a flush water tank assembly, which is designed to operate a water discharge valve disposed in a flush water tank to start supply of flush water to a toilet main unit.

BACKGROUND ART

Heretofore, there has been known a flush toilet configured such that, when a user operates an operating lever attached to a tank, a wire is interlockingly displaced to thereby open and close a water discharge valve of the tank.

As described in the Patent Document 1 (CN-U 2641156A), a conventionally known operating device comprises a link mechanism consisting of a plurality of links as illustrated in FIGS. 18 and 19. In this type of operating device, when a hand toggle 201 for water discharge of a water tank is rotated, a transmission rod 202 is rotated to cause a rotary disk 204 connected to the transmission rod 202 to be rotated. When the rotary disk 204 is rotated, a connecting rod 206 is pulled upwardly, and a guide block 208 is in turn pulled up toward a vertically upward direction while being guided on a guide rail within casings 209, 211. This movement of the guide block 208 causes a transmission rope 210 to pull and move a valve element opening mechanism to control water discharge. In the operating device described in the Patent Document 1, a wire member (the transmission rope 210) is pulled up toward a vertically upward direction through the link mechanism consisting of a plurality of links (the rotary disk 204, connecting rod 206, and guide block 208) to thereby cause the wire member to be displaced to a distance required for the wire member to open and close the valve element opening mechanism.

SUMMARY OF THE INVENTION

Technical Problem

However, in this type of operating device with an operating lever, the link mechanism pulls up the wire upwardly and linearly, so that it requires having a relatively long distance of motion range in an up-down direction. Thus, the operating device comprising the link mechanism is formed to have an entire length increased in an up-down direction. Therefore, this type of operating device has a problem that it is not suitable for a recently-preferred low-silhouette type of tank assembly. More specifically, in the low-silhouette type of tank having a relatively low height in an up-down direction, a distance between a maximum water level position within the tank and an attachment position of the operating device becomes relatively short. Thus, when the link mechanism-based operating device is formed to have an entire length increased in an up-down direction, a part of the operating device will be located under water. This causes a problem that the link mechanism and the wire may gather rust, scale, or the like to prevent a stable operation of the operating device.

The present invention has been made to solve the problems in the above conventional technique, and an object thereof is to provide an operating device capable of ensuring that a coupling member is displaced to an amount sufficient to cause a water discharge valve to be moved upwardly and opened through a rotation mechanism of a drive unit, and allowing the entire size of the drive unit to be decreased, so that stable operation of the operating device becomes possible without causing the drive unit to be located under a water level of flush water stored in a flush water tank.

Solution to Problem

In order to achieve the object, according to a first aspect of the present invention, there is provided an operating device for a flush water tank assembly, which is designed to operate a water discharge valve disposed in a flush water tank to start supply of flush water to a toilet main unit, comprising: an operating member disposed in a lateral region of an outer surface of the flush water tank, and configured to be rotationally moved according to a rotational operation performed by a user; a rotary shaft for transmitting the rotational movement of the operating member to an inside of the flush water tank; a drive unit disposed above a level of flush water within the flush water tank, and driven according to the rotational movement of the rotary shaft, the coupling member coupling the drive unit and the water discharge valve together, and capable of opening and closing the water discharge valve by means of its own displacement, wherein the drive unit comprises a rotation mechanism configured to be rotated at a radius of rotation greater than that of the rotary shaft, the rotation mechanism being operable to roll up the coupling member along its own rotational direction.

In the operating device of the present invention, the rotation mechanism of the drive unit is configured, with respect to the rotational movement of the operating member, to be rotated at a radius of rotation greater than that of the rotary shaft, and to roll up the coupling member along its own rotational direction. Thus, it is ensured that the coupling member is displaced to an amount sufficient to cause a water discharge valve to be moved upwardly and opened. In addition, due to the configuration of the rotation mechanism to roll up the coupling member along its own rotational direction, the entire length of the drive unit in an up-down direction can be decreased more than ever before, so that the entire size of the drive unit can be decreased. Therefore, the drive unit can be disposed in a low-silhouette type of flush water tank having a low height in an up-down direction. Further, the drive unit is not located under a water level of flush water stored in the flush water tank when it is disposed in the low-silhouette type of flush water tank. This prevents generation of rust, scale, or the like on the coupling member to enable a stable operation of the operating device comprising the coupling member.

Preferably, in the operating device of the present invention, the rotation mechanism of the drive unit comprises: a first rotary gear member attached to the rotary shaft in interlocking relation to the rotary shaft, and having a first tooth portion formed with external teeth; a rotary roll-up member having a roll-up member tooth portion which is a part of an outer periphery thereof formed with external teeth, and a fixing portion fixing the coupling member while allowing the coupling member to extend along the outer periphery thereof, the rotary roll-up member being configured to roll up the coupling member along its own rotational direction; and a second rotary gear member having a second tooth portion formed with external teeth and meshable with each of the first tooth portion and the roll-up member tooth portion.

In the operating device of the present invention, the rotation mechanism of the drive unit is configured to allow the first tooth portion rotated in interlocking relation to the rotary shaft to be rotated in mesh with the second tooth portion, and the second tooth portion is rotated in mesh with the roll-up member tooth portion, respectively. Thus, the rotary roll-up member is rotated in accordance with a rotational amount transmitted and amplified through the teeth, and configured to roll up the coupling member in its own rotational direction from the fixing portion along the outer periphery thereof. This makes it possible to ensure that a coupling member is displaced to an amount sufficient to cause a water discharge valve to be moved upwardly and opened even with a relatively small rotational movement of the operating member. Therefore, due to the configuration of the rotary roll-up member to roll up the coupling member in its own rotational direction along the outer periphery thereof, the entire length of the drive unit in an up-down direction can be decreased more than ever before, so that the entire size of the drive unit can be decreased.

Preferably, in the operating device of the present invention, the rotary roll-up member is configured such that a rotational center shaft has an axis identical to that of the rotary shaft to which the first rotary gear member is attached.

In the operating device of the present invention, since the rotary roll-up member is configured such that a rotational center shaft has an axis identical to that of the rotary shaft to which the first rotary gear member is attached, it can be rotated in an area that is bilaterally symmetric about the axis of the rotary shaft. This makes it possible to cause a rotational movement area in which the rotary roll-up member is permitted to make a rotational movement to be formed smaller, and to ensure that a coupling member is displaced to an amount sufficient to cause a water discharge valve to be moved upwardly and opened. Therefore, the entire size of the drive unit can be further decreased, and the drive unit can be disposed in a low-silhouette type of flush water tank having a low height in an up-down direction. Further, the drive unit is not located under a water level of flush water stored in the flush water tank when it is disposed in the low-silhouette type of flush water tank. This prevents generation of rust, scale, or the like on the coupling member to enable a stable operation of the operating device comprising the coupling member.

Preferably, in the operating device of the present invention, the rotary roll-up member comprises: a first outer peripheral portion at which the fixing portion is disposed and which is formed to have a relatively large curvature radius; and a second outer peripheral portion which forms the roll-up member tooth portion and which is formed to have a curvature radius smaller than that of the first outer peripheral portion.

In the operating device of the present invention, the rotary roll-up member is formed to allow the first outer peripheral portion formed to have a relatively large curvature radius and the second outer peripheral portion formed to have a curvature radius smaller than that of the first outer peripheral portion to be rotated about the same rotational center shaft. Therefore, the first outer peripheral portion configured to roll up the coupling member fixed to the fixing portion and the second outer peripheral portion having the roll-up member tooth portion configured to be meshable with the second tooth portion can be rotated about the same rotational center shaft. Thus, the first outer peripheral portion and the second outer peripheral portion can be formed on the same plane. This makes it possible to form the rotary roll-up member to have a small thickness as compared to the case where the first outer peripheral portion and the second outer peripheral portion are not formed on the same plane, so that the size of the rotary roll-up member itself can be decreased.

Preferably, in the operating device of the present invention, the drive unit comprises a covering member covering the rotation mechanism, the covering member having a restricting portion formed thereinside, wherein the second rotary gear member is formed in a partial shape smaller than a semicircle, and wherein the drive unit is configured to allow a lateral surface of the partial shape and the restricting portion to come into contact with each other to thereby restrict a range in which a user is permitted to perform the rotational operation of the operating member.

In the operating device of the present invention, the drive unit is configured to allow a lateral surface of the partial shape and the restricting portion to come into contact with each other to thereby restrict a range in which a user is permitted to perform the rotational operation of the operating member. This eliminates the need for newly providing any restriction means for restricting a range in which a user is permitted to perform the rotational operation of the operating member, so that the entire size of the drive unit can be further decreased. Further, the second rotary gear member is formed in a partial shape smaller than a semicircle, so that the size thereof can be decreased. Thus, the size of the covering member covering the rotation mechanism comprising the second rotary gear member can be decreased, so that the entire size of the drive unit can be further decreased.

Preferably, in the operating device of the present invention, the drive unit is configured to allow an arrangement of the second rotary gear member and the rotary roll-up member of the rotation mechanism to be changed, whereby the drive unit can be attached to the operating member, irrespective of whether the operating member is attached to a left lateral region or a right lateral region of the outer surface of the flush water tank.

In the operating device of the present invention, the drive unit is configured to allow an arrangement of the second rotary gear member and the rotary roll-up member of the rotation mechanism to be changed, whereby the drive unit can be attached to the operating member, irrespective of whether the operating member is attached to a left lateral region or a right lateral region of the outer surface of the flush water tank. Thus, it becomes possible to attach the operating device to either of a left lateral region or a right lateral region of the flush water tank.

Preferably, in the operating device of the present invention, the rotation mechanism of the drive unit comprises: a first rotary gear member attached to the rotary shaft in interlocking relation to the rotary shaft, and having a first tooth portion formed with external teeth; and a rotary roll-up member for rolling up the coupling member along its own rotational direction, the rotary roll-up member having a roll-up member tooth portion which is a part of an outer periphery thereof formed with external teeth and meshable with the first rotary gear member, and a fixing portion fixing the coupling member while allowing the coupling member to extend along the outer periphery thereof.

In the operating device of the present invention, the rotation mechanism of the drive unit is configured to allow the first tooth portion rotated in interlocking relation to the rotary shaft to be rotated in mesh with the roll-up member tooth portion. Thus, the rotary roll-up member is rotated in accordance with a rotational amount transmitted and amplified through the teeth, and rolls up the coupling member in its own rotational direction from the fixing portion along the outer periphery thereof. This makes it possible to ensure that a coupling member is displaced to an amount sufficient to cause a water discharge valve to be moved upwardly and opened even with a relatively small rotational movement of the operating member. Thus, due to the configuration of the rotary roll-up member to roll up the coupling member in its own rotational direction along the outer periphery thereof, the entire length of the drive unit in an up-down direction can be decreased more than ever before, so that the whole size of the drive unit can be decreased. Therefore, the drive unit can be disposed in a low-silhouette type of flush water tank having a low height in an up-down direction. Further, the drive unit is not located under a water level of flush water stored in the flush water tank when it is disposed in the low-silhouette type of flush water tank. This prevents generation of rust, scale, or the like on the coupling member to enable a stable operation of the operating device comprising the coupling member.

Preferably, in the operating device of the present invention, the rotary roll-up member comprises: a first outer peripheral portion at which the fixing portion is disposed and which is formed to have a relatively large curvature radius; and a second outer peripheral portion which forms the roll-up member tooth portion and which is formed to have a curvature radius smaller than that of the first outer peripheral portion.

In the operating device of the present invention, the rotary roll-up member comprises the fixing portion fixing the coupling member provided on the first outer peripheral portion having a relatively large curvature radius, whereby the coupling member is rolled up along the first outer peripheral portion. This makes it possible to ensure that a coupling member is displaced to an amount sufficient to cause a water discharge valve to be moved upwardly and opened. Further, the rotary roll-up member allows the first outer peripheral portion configured to roll up the coupling member fixed to the fixing portion and the second outer peripheral portion having the roll-up member tooth portion configured to be meshable with the first tooth portion to be rotated about the same rotational center shaft. Thus, the first outer peripheral portion and the second outer peripheral portion can be formed on the same plane. This makes it possible to form the rotary roll-up member to have a small thickness as compared to the case where the first outer peripheral portion and the second outer peripheral portion are not formed on the same plane, so that the size of the rotary roll-up member itself can be decreased.

According to a second aspect of the present invention, there is provided a flush water tank assembly comprising the above operating device.

The flush water tank assembly of the present invention can ensure a stable operation.

According to a third aspect of the present invention, there is provided a flush toilet comprising the above flush water tank assembly.

The flush toilet of the present invention can ensure a stable operation.

Advantageous Effect of Invention

According to the operating device of the present invention, the rotation mechanism of the drive unit is configured to be rotated at a radius of rotation greater than that of the rotary shaft, and to roll up the coupling member along its own rotational direction. This makes it possible to ensure that the coupling member is displaced to an amount sufficient to cause a water discharge valve to be moved upwardly and opened, and allow the entire size of the drive unit to be decreased, so that stable operation of the operating device becomes possible without causing the drive unit to be located under a water level of flush water stored in a flush water tank.

DESCRIPTION OF EMBODIMENTS

With reference to the accompanying drawings, an operating device for a flush water tank assembly according to a first embodiment of the present invention, a flush water tank assembly equipped with the operating device, and a flush toilet equipped with the flush water tank assembly, will now be described.

First of all, based on FIG. 1, a flush toilet using a flush water tank assembly equipped with the operating device according to the first embodiment of the present invention will be described below.

Figure 1:
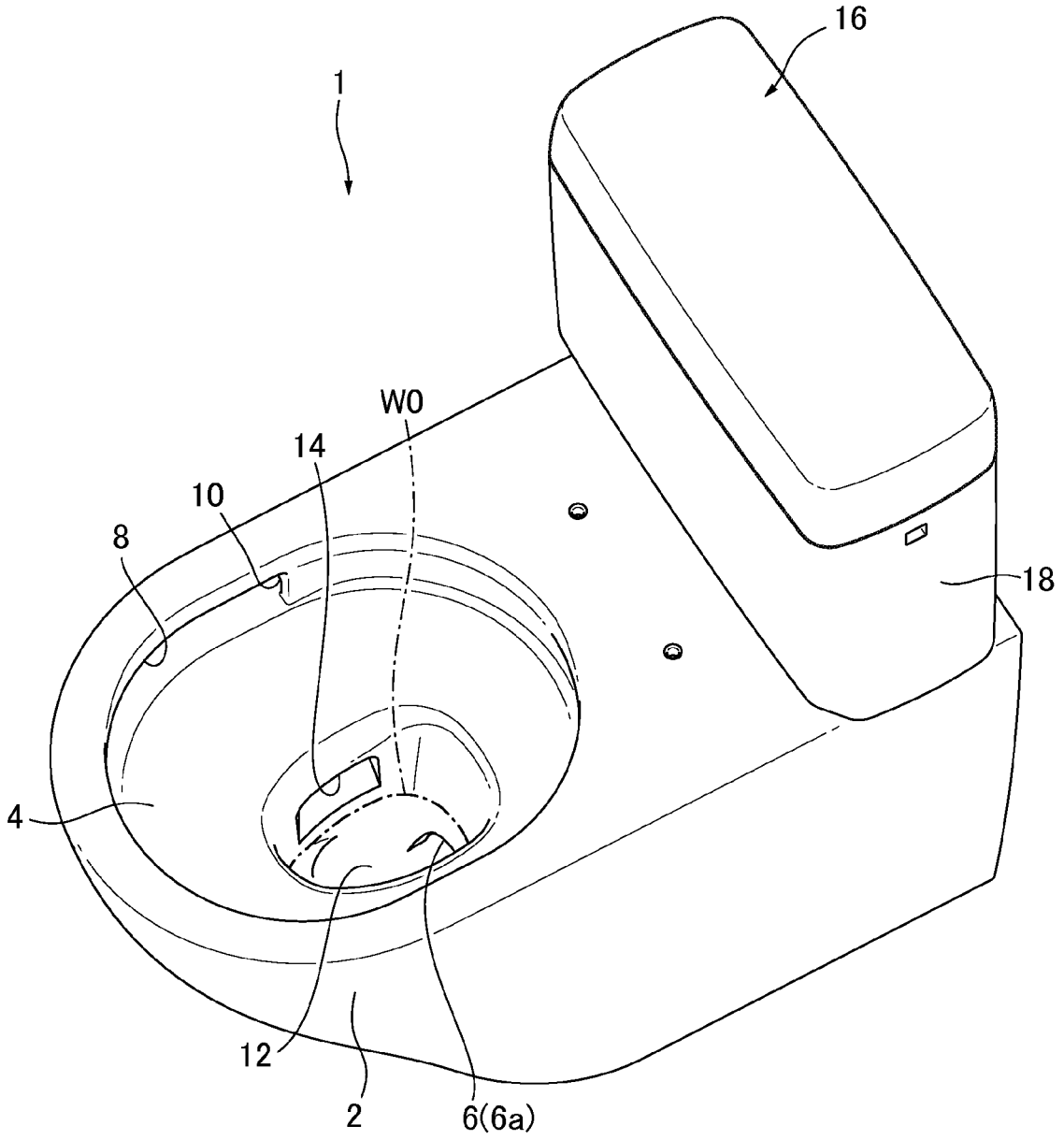
FIG. 1 is a perspective view illustrating a flush toilet using a flush water tank assembly comprising an operating device according to a first embodiment of the present invention, wherein a toilet seat and a toilet cover are removed therefrom.

FIG. 1 is a perspective view illustrating a flush toilet using a flush water tank assembly comprising an operating device according to a first embodiment of the present invention, wherein a toilet seat and a toilet cover are removed therefrom.

As illustrated in FIG. 1, the reference numeral 1 indicates a so-called siphon-type flush toilet designed to suck waste in a bowl portion and discharge the waste from a drainage trap passage to the outside at once, by means of a siphon action. The flush toilet 1 comprises a toilet main unit 2 made of porcelain. The toilet main unit 2 is formed with a bowl portion 4, and a drainage trap passage 6 communicated with a bottom of the bowl portion 4.

The bowl portion 4 of the toilet main unit 2 has an upper edge formed with an inwardly overhanging rim 8, and a first spout port 10 for spouting flush water supplied from a water conduit (not illustrated) formed inside a rear of the toilet main unit 2. Specifically, the toilet main unit 2 is configured to allow flush water spouted from the first spout port 10 to spirally whirling downwardly along an inner surface thereof to thereby flush the bowl portion 4.

The bowl portion 4 has a lower region formed as a water pooling region 12 capable of pooling water at up to a water level (pooled-water level) indicated by the one-dot chain line W0. An inlet 6*a* of the drainage trap passage 6 is opened at a bottom of the water pooling region 12, and an outlet of the drainage trap passage 6 located rearward of the inlet 6*a* is connected to a drain pipe (not illustrated) arranged under a floor, via a drain socket (not illustrated).

The bowl portion 4 further has a second spout port 14 formed at a position above the pooled-water level W0 to spout flush water supplied from the water conduit (not illustrated) formed inside the rear of the toilet main unit 2. Specifically, the toilet main unit 2 is configured to allow flush water spouted from the second spout port 14 to cause water pooled in the water pooling region 12 to have a flow whirling in an up-down direction.

A flush water tank assembly 16 is provided on an upper surface of the rear of the toilet main unit 2 to store flush water to be supplied to the toilet main unit 2.

Although the first embodiment will be described based on an example in which the flush water tank assembly 16 is applied to the above siphon-type flush toilet, a scope of application of the present invention is not limited to the siphon-type flush toilet, but the present invention can also be applied to any other type of flush toilet, such as a so-called wash down-type flush toilet designed to wash away waste by means of a water flow action caused by water head within the bowl portion.

Secondly, based on FIG. 2, an internal structure of the flush water tank assembly 16 will be described below.

Figure 2:
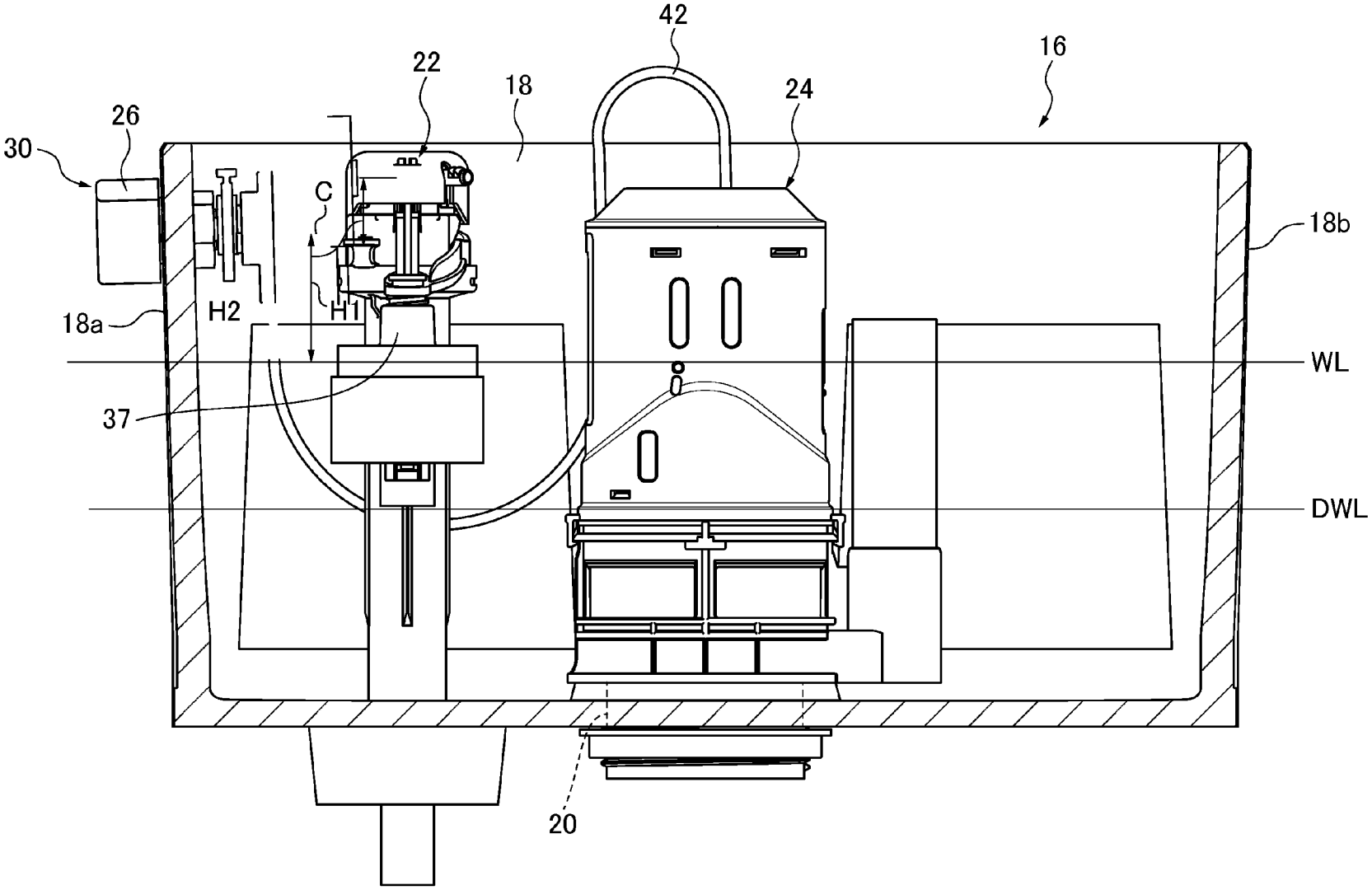
FIG. 2 is a front sectional view illustrating an internal structure of the flush water tank assembly comprising the operating device according to the first embodiment of the present invention.

FIG. 2 is a front sectional view illustrating an internal structure of the flush water tank assembly comprising the operating device according to the first embodiment of the present invention. In FIG. 2, a maximum water level and a dead water level within an aftermentioned flush water tank 18 are designated by WL and DWL, respectively.

As illustrated in FIGS. 1 and 2, the flush water tank assembly 16 comprises a flush water tank 18 for storing therein flush water for flushing the flush toilet 1. The water storage tank 18 has a bottom formed with a water discharge port 20 which is communicated with the water conduit (not illustrated) of the toilet main unit 2 in such a manner as to allow flush water in the flush water tank 18 to be supplied to the water conduit (not illustrated) of the toilet main unit 2. It is to be understood that an amount of flush water to be stored in the flush water tank 18 varies depending on types of toilets.

The flush water tank 18 is a so-called low-silhouette type flush water tank, in which a height of a position of an upper end of the flush water tank 18 is set lower than that of a relatively longitudinally long, so-called high-silhouette type flush water tank. The low-silhouette type flush water tank 18 is formed in a laterally long flat shape to have a relatively reduced height, so that a height H1 in an up-down direction (a size of a space in which an aftermentioned operating device 30 can be installed) between a rotational axis C of an aftermentioned rotary shaft 34 of an aftermentioned operating device 30 and the maximum water level WL is provided to be relatively small.

As illustrated in FIG. 2, the flush water tank assembly 16 further comprises a flush water supply device 22 provided inside the flush water tank 18, wherein the flush water supply device 22 is designed to supply flush water into the flush water tank 18. The flush water tank assembly 16 further comprises a water discharge valve device 24 provided inside the flush water tank 18, wherein the water discharge valve device 24 is designed to open a water discharge port 20 so as to cause flush water stored in the flush water tank 18 to flow into the water conduit (not illustrated) of the toilet main unit 2. Further, the flush water tank assembly 16 comprises an operating device 30 provided inside the flush water tank 18, wherein the operating device 30 is designed to, when an operating handle 26 attached to an outside of the flush water tank 18 is turned in a direction for causing a flushing operation to be performed, cause a control wire 28 (see FIG. 6) interlockingly coupled to the operating handle 26 to physically pull up a valve element (not illustrated) of the water discharge valve device 24.

The water discharge valve device 24 has the same configuration as that of a conventional water discharge valve device, so that the concrete description thereof will be omitted. The water discharge valve device 24 is a so-called direct acting type water discharge valve device, in which the control wire 28 is connected to the valve element (not illustrated) of the water discharge valve device 24, wherein the water discharge valve device 24 is configured such that an amount of displacement in which the control wire 28 is permitted to be displaced corresponds to an amount of movement in an up-down direction of the valve element (not illustrated) of the water discharge valve device 24. When the operating handle 26 is turned, the control wire 28 interlockingly pulls up the valve element (not illustrated) of the water discharge valve device 24, and thereby supply of flush water is started to the flush toilet 1. Then, the water discharge port 20 is opened for a given period of time to allow a certain amount of flush water in the flush water tank 18 to be discharged to the water conduit (not illustrated) of the toilet main unit 2.

Thirdly, with reference to FIGS. 2 to 6, details of the operating device according to the first embodiment of the present invention will be described below.

Figure 3:
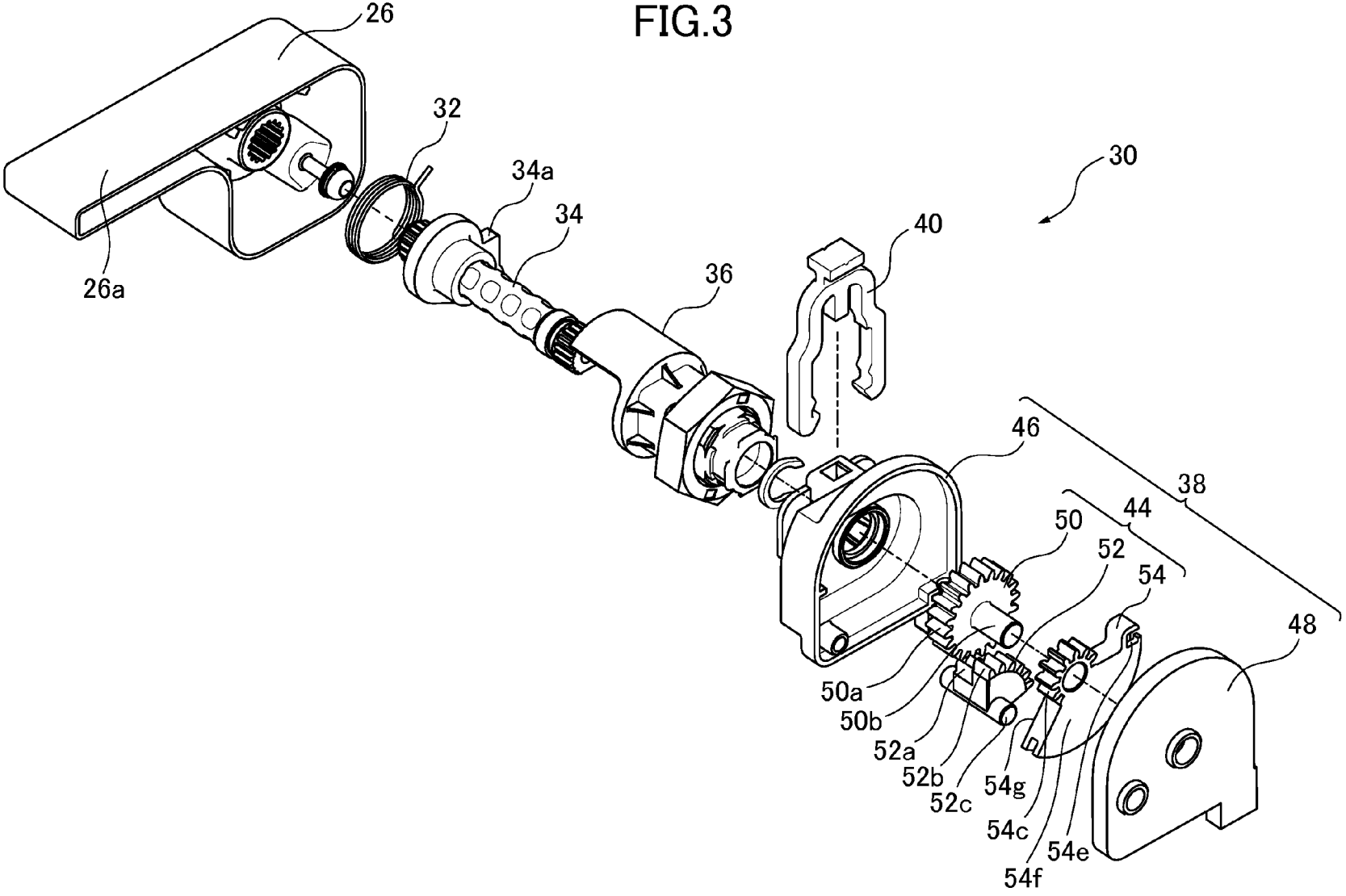
FIG. 3 is an exploded perspective view illustrating the operating device according to the first embodiment of the present invention.
Figure 4:
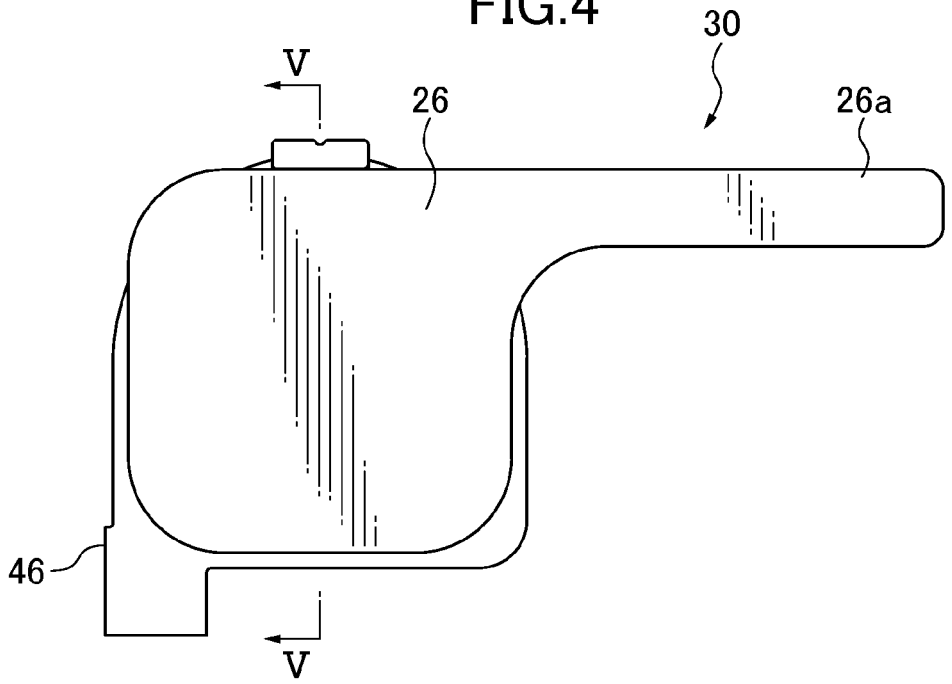
FIG. 4 is a plane view illustrating the operating device according to the first embodiment of the present invention.
Figure 5:
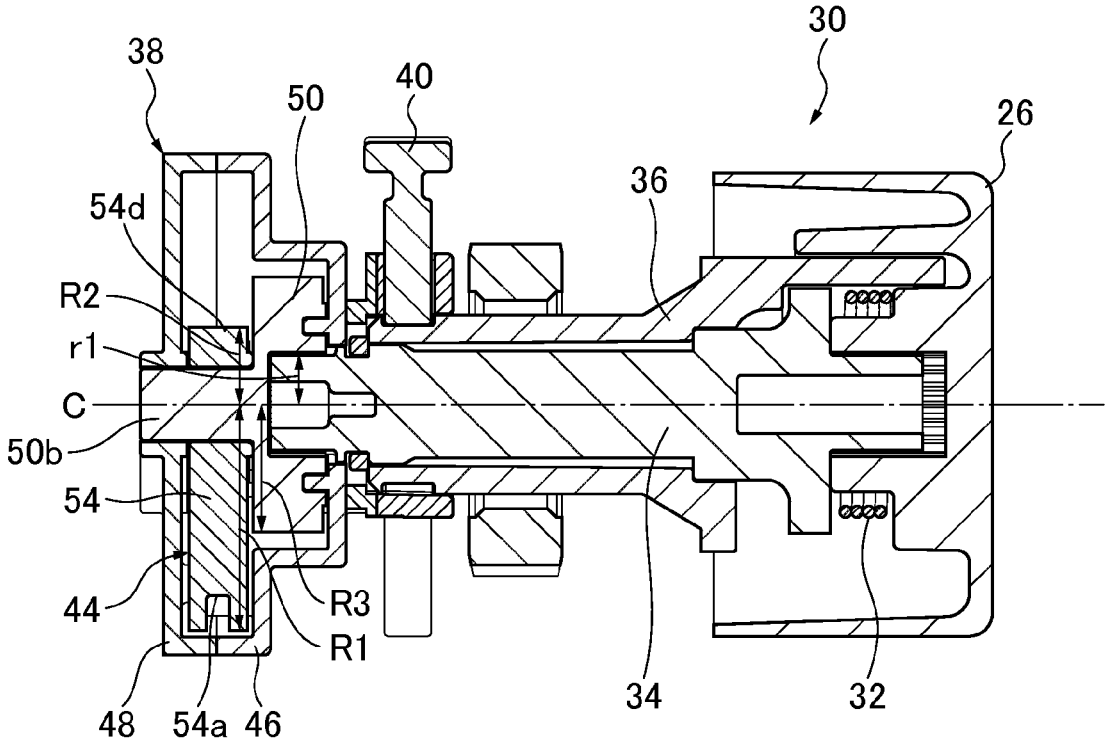
FIG. 5 is a sectional view taken along the line V-V in FIG. 4.
Figure 6:
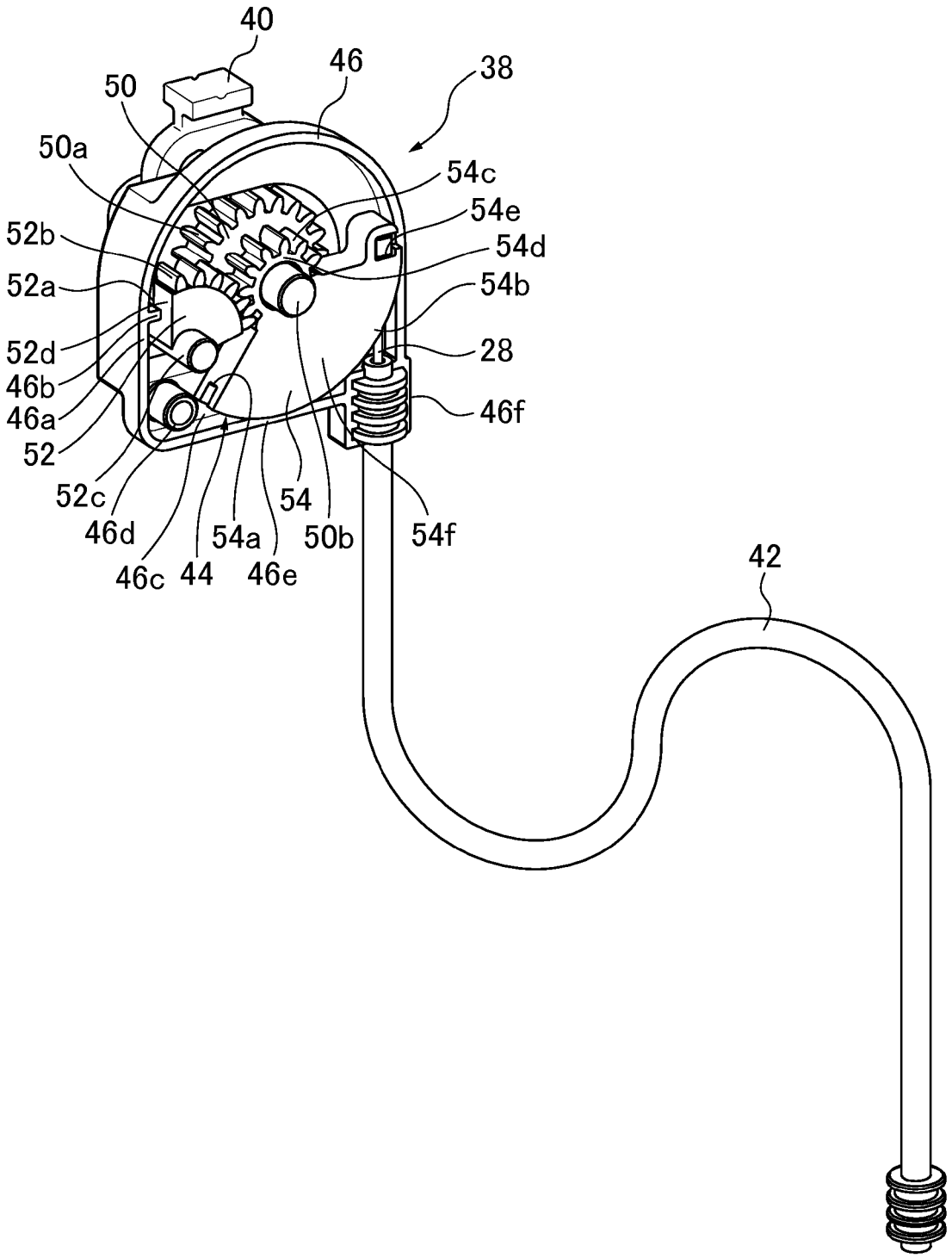
FIG. 6 is a perspective view illustrating an internal structure of a drive unit in the operating device according to the first embodiment of the present invention, wherein a tube end on the water discharge device side is unconnected.

FIG. 2 is a front sectional view illustrating an internal structure of the flush water tank assembly comprising the operating device according to the first embodiment of the present invention, and FIG. 3 is an exploded perspective view illustrating the operating device according to the first embodiment of the present invention. FIG. 4 is a plane view illustrating the operating device according to the first embodiment of the present invention, and FIG. 5 is a sectional view taken along the line V-V in FIG. 4. FIG. 6 is a perspective view illustrating an internal structure of a drive unit in the operating device according to the first embodiment of the present invention, wherein a tube end on the water discharge device side is unconnected.

As illustrated in FIGS. 2 to 6, the operating device 30 according to the first embodiment of the present invention comprises an operating handle 26 disposed in a left lateral region 18*a* of the outer surface of the flush water tank 18, and configured to be rotationally moved according to a rotational operation performed by a user, wherein the left lateral region 18*a* is located on the left side as viewed from a front of the toilet main unit. The operating device 30 further comprises a spring 32 configured to, when a user performs the rotational manipulation of the operating handle 26, exert a force to return the operating handle 26 to a standby state position. The operating device 30 further comprises a rotary shaft 34 for transmitting the rotational movement of the operating handle 26 to an inside of the flush water tank 18, and a rotary shaft guide 36 for supporting the rotary shaft 34. The operating device 30 further comprises a drive unit 38 disposed above the maximum water level WL of flush water within the flush water tank 18, and configured to transmit the rotational movement of the rotary shaft 34 to displace an aftermentioned control wire 28. The operating device 30 further comprises: a snap ring 40 for fastening the rotary shaft 34, the rotary shaft guide 36 and the drive unit 38; and a control wire 28 coupling the drive unit 38 and the water discharge valve device 24 together, and capable of opening and closing the valve element (not illustrated) of the water discharge valve device 24 by means of its own displacement.

The operating handle 26 is a left operating handle attached to the left lateral region 18*a* of the flush water tank 18, and has a handling portion 26*a* configured to be operated downwardly by a user, e.g., with his/her finger, and extending to protrude forward to the user side. The operating handle 26 is adapted, when the user pushes the handling portion 26*a* downwardly, to generate a rotational movement about the rotary shaft 34.

The rotary shaft 34 is formed to extend through the flush water tank 18 from the outside to the inside thereof, and is horizontally disposed in a right-left direction of the flush water tank 18. The rotary shaft 34 is fitted with the operating handle 26 on the outside of the flush water tank 18, and is connected to the drive unit 38 on the inside of the flush water tank 18. The rotary shaft 34 is formed with a rotation stopper 34*a*, and is configured to, when the user performs the rotational operation of the operating handle 26, allow the rotation stopper 34*a* to come into contact with the rotary shaft guide 36 to thereby restrict a range of rotation of the operating handle 26 from its standby state up to 45 degrees.

The control wire 28 runs through a flexible tube 42 extending from the inside of the drive unit 38 to the inside of the water discharge valve device 24, and is extended to the inside of the drive unit 38 from one end of the tube 42 opened toward the inside of the drive unit 38. The control wire 28 is slidably disposed within the tube 42.

The drive unit 38 comprises a rotation mechanism 44 configured to be rotated about the rotary shaft 34 based on a rotational force of the rotary shaft 34. The drive unit 38 further comprises a covering member 46 having a surrounding wall 46*a* rising toward an inward of the flush water tank 18 so as to cover the outer side of the rotation mechanism 44. The drive unit 38 further comprises a covering cap 48 configured to be combined with the covering member 46 in such a manner as to apply a cap from the inward of the flush water tank 18 thereby to form an outer periphery of the drive unit 38 together with the covering member 46. The covering member 46 is formed in a compact shape to cover the outer periphery of the rotation mechanism 44.

The rotation mechanism 44 is configured to be rotated at a curvature radius (radius of rotation) R1 (see description below) larger than a curvature radius (radius of rotation) r1 of the rotary shaft 34.

The covering member 46 comprises a first restricting portion 46*b* formed on the surrounding wall 46*a* inside the covering member 46, a second restricting portion 46*d* protruding from a basal wall 46*c* inside the covering member 46, and a tube attachment portion 46*f* for allowing the tube 42 to be attached thereto.

The operating device 30 according to the first embodiment of the present invention is an operating device attached to the left lateral region 18*a* of the flush water tank 18 so as to facilitate the operation of the user with his/her left hand. Alternatively, the operating device 30 may be an operating device attached to the right lateral region 18*b* of the flush water tank 18 so as to facilitate the operation of the user with his/her right hand.

Next, with reference to FIGS. 3, 5 and 6, the rotation mechanism of the drive unit of the operating device according to the first embodiment of the present invention will be described in more detail below.

The rotation mechanism 44 of the drive unit 38 comprises a first rotary gear member 50 attached to the rotary shaft 34 to be interlockingly rotated with the rotary shaft 34, and having a first tooth portion 50*a* formed with external teeth. The rotation mechanism 44 further comprises a second rotary gear member 52 having an aftermentioned outer second tooth portion 52*a* formed with external teeth and meshable with the first tooth portion 50*a*. The rotation mechanism 44 further comprises a rotary roll-up member 54 meshable with the second rotary gear member 52 and configured to roll up the control wire 28 along its own rotational direction.

As described above, the first rotary gear member 50 has the first tooth portion 50*a* formed on an outer periphery thereof to form a circular gear. In order to be rotated with the rotary shaft 34, the first rotary gear member 50 is disposed such that the rotary shaft 34 is attached thereto in such a manner as to be fitted in a central region of the first rotary gear member 50 and the first rotary gear member 50 is rotated about the rotational axis C of the rotary shaft 34.

Further, the first rotary gear member 50 has a rotational support shaft 50*b* (rotational center shaft) formed to extend horizontally while having the same axis C as the rotational axis C of the rotary shaft 34. Since the first rotary gear member 50 is rotated with the rotary shaft 34, in this embodiment, when the operating handle 26 is rotationally operated 45 degrees, then the rotary shaft 34 is rotated 45 degrees, and the first rotary gear member 50 is rotated 45 degrees.

The second rotary gear member 52 is formed as a gear having a partial shape (a fan-like shape or a partial circular shape), such as a shape cut out from a circular shape, and has an outer second tooth portion 52*a* and an inner second tooth portion 52*b*, each formed on an outer periphery thereof. The second rotary gear member 52 is formed in a partial shape smaller than a semicircle. Further, the second rotary gear member 52 has a second rotary gear shaft 52*c* disposed horizontally in a right-left direction of the flush water tank 18.

The outer second tooth portion 52*a* is disposed on the second rotary gear shaft 52*c* at an outer side of the flush water tank 18 so as to be meshable with the first tooth portion 50*a*, and is formed as a partially-shaped gear having an outer periphery formed with external teeth. The inner second tooth portion 52*b* is disposed on the second rotary gear shaft 52*c* at an inner side of the flush water tank 18 so as to be meshable with an aftermentioned roll-up member tooth portion 54*c*, and is formed as a partially-shaped gear having an outer periphery formed with external teeth. The second rotary gear member 52 is configured such that when the outer second tooth portion 52*a* is rotationally moved, the inner second tooth portion 52*b* is also rotationally moved together in the same direction.

The second rotary gear shaft 52*c* of the second rotary gear member 52 is rotationally attached between the covering member 46 and the covering cap 48 at a position apart from the rotary shaft 34. The second rotary gear member 52 is adapted to be rotated based on a force transmitted through the mesh between the first tooth portion 50*a* and the outer second tooth portion 52*a*. Further, in this embodiment, the second rotary gear member 52 is configured such that when the first tooth portion 50*a* is rotationally moved 45 degrees, the outer second tooth portion 52*a* is rotated in accordance with an amplified rotational amount of 75 degrees, and accordingly, the inner second tooth portion 52*b* is rotated 75 degrees. As a result, he second rotary gear member 52 is rotated 75 degrees about the second rotary gear shaft 52*c*. Since the second rotary gear member 52 is formed in a compact partial shape smaller than a semicircle, the range of movement in which the second rotary gear member 52 is permitted to be rotated is relatively small. Thus, the covering member 46 covering the rotation mechanism 44 comprising the second rotary gear member 52 is also formed to have a relatively small size.

The second rotary gear member 52 comprises a first cutout lateral surface 52*d* on one side of the partial shape, and a second cutout lateral surface 52*e* on the other side of the partial shape. The first cutout lateral surface 52*d* is allowed to come into contact with the first restricting portion 46*b* to thereby be restricted to prevent the second rotary gear member 52 from being rotated further toward the first restricting portion 46*b*. The second cutout lateral surface 52*e* is allowed to come into contact with the second restricting portion 46*d* to thereby be restricted to prevent the second rotary gear member 52 from being rotated further toward the second restricting portion 46*d*. Usually, the range of rotation of the operating handle 26 from its standby state is limited up to 45 degrees by mean of the rotation stopper 34*a*. However, even in the case where the rotation stopper 34*a* is omitted, or the rotation stopper 34*a* is not functioning for any reason, the second cutout lateral surface 52*e* is allowed to come into contact with the second restricting portion 46*d*, so that the second rotary gear member 52 becomes limited in its function as a gear and restricted in its range of rotation. This makes it possible to prevent the control wire 28 from being pulled to an unexpected amount of displacement to cause a failure of the operating device.

The rotary roll-up member 54 comprises: a first outer peripheral portion 54*b* formed as a pulley portion 54*a* having a length of about one third of entire circumference of the rotary roll-up member 54, and configured to roll up the control wire 28 along its own rotational direction; and a second outer peripheral portion 54*d* formed in a fan-like shape as a roll-up member tooth portion 54*c* having a length of about two third of the entire circumference. In the second outer peripheral portion 54*d*, the roll-up member tooth portion 54*c* is formed in external teeth so as to be meshable with the inner second tooth portion 52*b*. The rotary roll-up member 54 further comprises a fixing portion 54*e* formed on an upper end of the circumference on the first outer peripheral portion 54*b*, and configured to fix the control wire 28 while allowing the control wire 28 to extend along the first outer peripheral portion 54*b*.

The rotary roll-up member 54 is configured such that the rotational support shaft 50*b* supporting the rotation of the rotary roll-up member 54 has an axis C identical to that of the rotary shaft 34 to which the first rotary gear member 50 is attached. The rotary roll-up member 54 is attached such that it is supported by the rotational support shaft 50*b* inserted as a central support shaft in a central region thereof and is freely rotatable independently from the rotation of the rotational support shaft 50*b*. The rotary roll-up member 54 is formed as a single-piece rotary member in which the first outer peripheral portion 54*b* formed as the pulley portion 54*a* and the second outer peripheral portion 54*d* formed as the roll-up member tooth portion 54*c* are coaxially arranged on the same plane. Since the rotary roll-up member 54 is formed as a single-piece rotary member, the drive unit 38 is formed to have a small entire thickness as compared to the case where the first outer peripheral portion 54*b* formed as the pulley portion 54*a* and the second outer peripheral portion 54*d* formed as the roll-up member tooth portion 54*c* are separately formed as two pieces of rotary members.

In the rotary roll-up member 54, the first outer peripheral portion 54*b* is formed to have a relatively large curvature radius (radius of rotation) R1, and the second outer peripheral portion 54*d* is formed to have a curvature radius (radius of rotation) R2 smaller than the curvature radius (radius of rotation) R1 of the first outer peripheral portion 54*b*. Further, the curvature radius R1 of the first outer peripheral portion 54*b* is larger than a curvature radius (radius of rotation) R3 of the first rotary gear member 50. Thus, a great majority of an outer edge of an area in which the rotation mechanism 44 is permitted to be rotated is defined by an area in which the first outer peripheral portion 54*b* is permitted to be rotated, so that the covering member 46 may substantially be formed to have an outer shape covering the area in which the first outer peripheral portion 54*b* is permitted to be rotated. Therefore, the covering member 46 can have a lower wall 46*e* of the covering member 46 and the tube attachment portion 46*f*, each formed at a position below the rotational axis C of the rotary shaft 34 in an up-down direction by a distance slightly longer than the curvature radius R1 of the first outer peripheral portion 54*b*. The drive unit 38 is formed to have an entire length in an up-down direction shorter than ever before. Specifically, the drive unit 38 is formed to have a height H2 in an up-down direction from the rotational axis C of the rotary shaft 34 to the tube attachment portion 46*f* smaller than the height H1 in an up-down direction between the rotational axis C and the maximum water level WL. Thus, even when the height H1 in an up-down direction between the rotational axis C and the maximum water level WL is relatively low, it is possible to dispose the drive unit 38 above the maximum water level WL to prevent it from being located under water.

In this embodiment, when the inner second tooth portion 52*b* is rotationally moved 75 degrees, the roll-up member tooth portion 54*c* is rotated in accordance with an amplified rotational amount of 125 degrees, so that the rotary roll-up member 54 is rotated 125 degrees about the rotational support shaft 50*b*.

The pulley portion 54*a* of the rotary roll-up member 54 is formed in a groove-like shape that is radially-inwardly concaved along the first outer peripheral portion 54*b*. This makes it possible to cause the control wire 28 to be rolled up along the pulley portion 54*a* while being fitted in the groove-like pulley portion 54*a*.

The fixing portion 54*e* is continuously provided from the groove on an upper end of the pulley portion 54*a* of the rotary roll-up member 54. In the front view illustrated in FIG. 7, it is formed in a C-shape opening toward the outside of the rotary roll-up member 54. Thus, the fixing portion 54*e* is adapted to fix the control wire 28 by allowing a drive unit-side end 28*a* of the control wire 28 to be fitted in the C-shaped fixing portion, while allowing the control wire 28 to be directed to the outer periphery of the rotary roll-up member 54 so that it can be extended along the pulley portion 54*a*.

The rotary roll-up member 54 is adapted, when the rotation mechanism 44 of the drive unit 38 is connected via the rotary shaft 34 to the operating handle 26 disposed on the left lateral region 18*a* of the flush water tank 18, to be disposed by causing a front side 54*f* of the rotary roll-up member 54 to be faced to the inner side of the flush water tank 18, and a back side 54*g* (not illustrated) to be faced to the outer side of the flush water tank 18.

The rotary roll-up member 54 is formed such that an angle $\alpha$ forming the fan-like shape has a measure that allows the control wire 28 to be reliably rolled up along the first outer peripheral portion 54*b* to an amount of displacement for causing a water discharge valve to be sufficiently moved upwardly by causing the rotary roll-up member 54 having the curvature radius R1 to be rotated to the angle $\alpha$. As described above, the first tooth portion 50*a*, the outer second tooth portion 52*a*, the inner second tooth portion 52*b* and the roll-up member tooth portion 54*c* are configured to have a gear ratio enabling a rotation angle of the rotary roll-up member 54 to be increased to an angle that allows the control wire 28 to be reliably displaced to an amount sufficient to open and close the water discharge valve. The gear ratio of the first tooth portion 50*a*, the outer second tooth portion 52*a*, the inner second tooth portion 52*b* and the roll-up member tooth portion 54*c* can be changed.

Next, with reference to FIGS. 2 and 7 to 9, operations (functions) of the operating device according to a first embodiment of the present invention, the flush water tank assembly equipped with the operating device, and the flush toilet equipped with the flush water tank assembly, will now be described.

Figure 7:
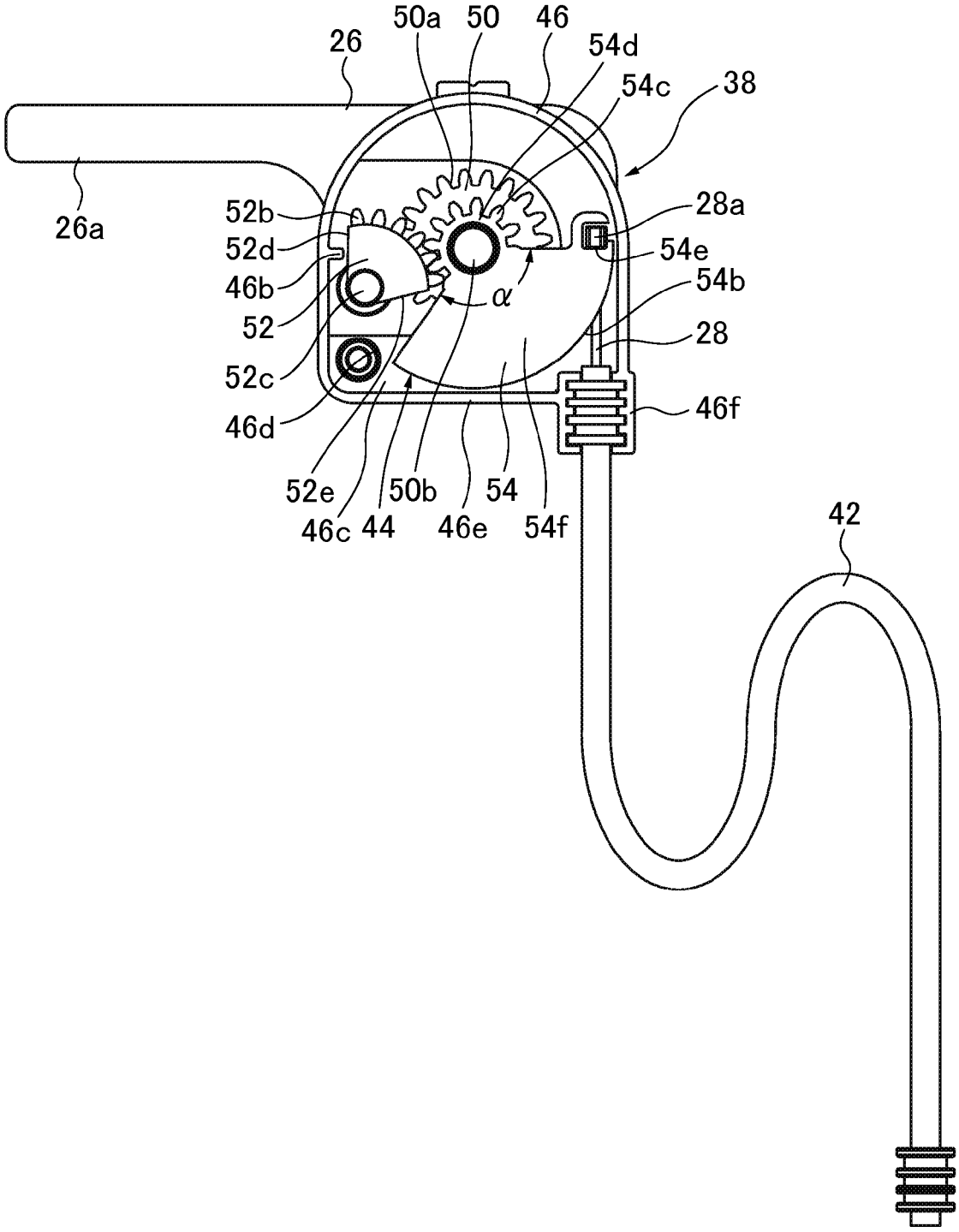
FIG. 7 is a front view illustrating the internal structure of the drive unit in a standby state just before rotational operation of an operating member, in the operating device according to the first embodiment of the present invention, wherein the tube end on the water discharge device side is unconnected.
Figure 8:
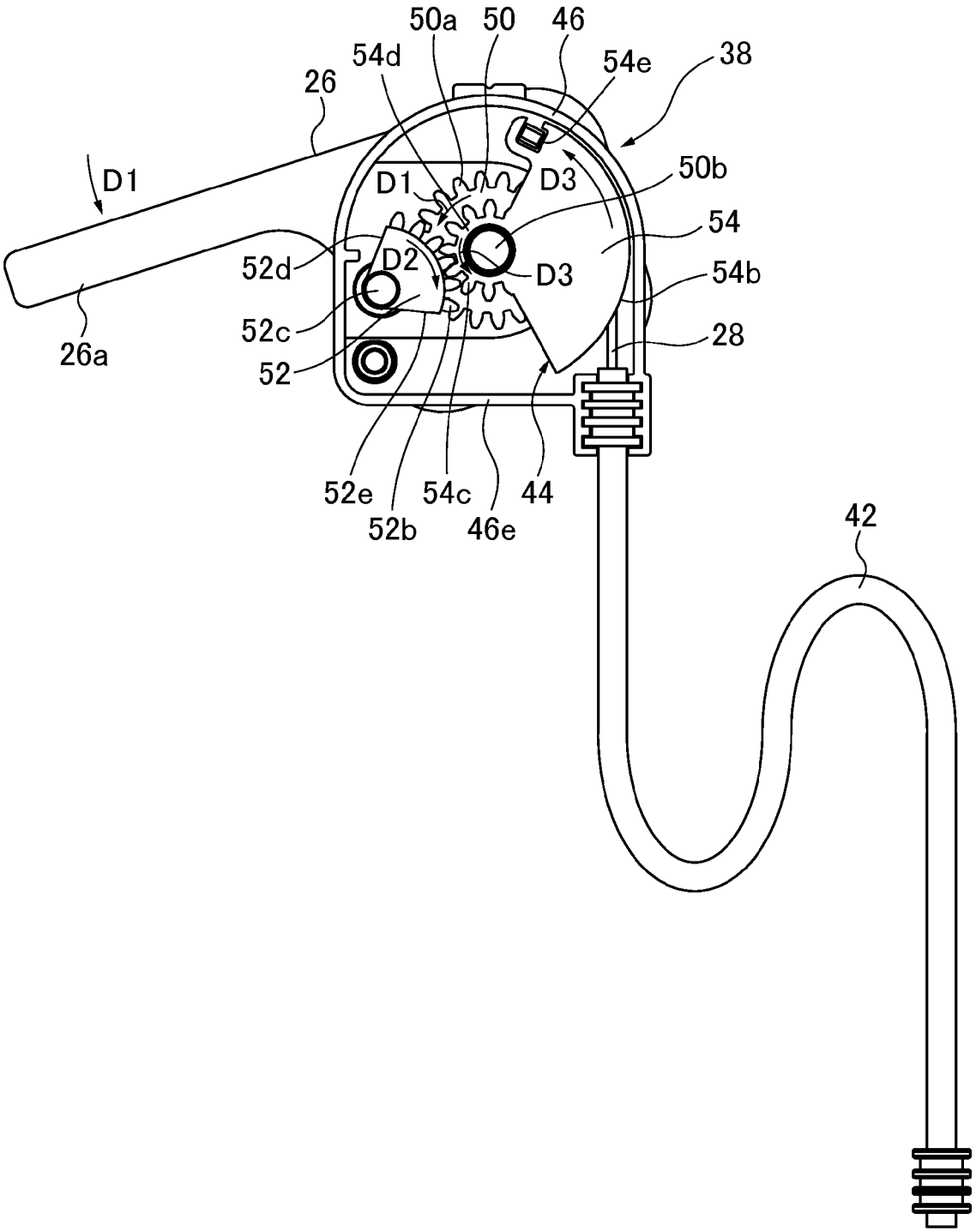
FIG. 8 is a front view illustrating the internal structure of the drive unit in a state during the rotational operation of the operating member, in the operating device according to the first embodiment of the present invention, wherein the tube end on the water discharge device side is unconnected.
Figure 9:
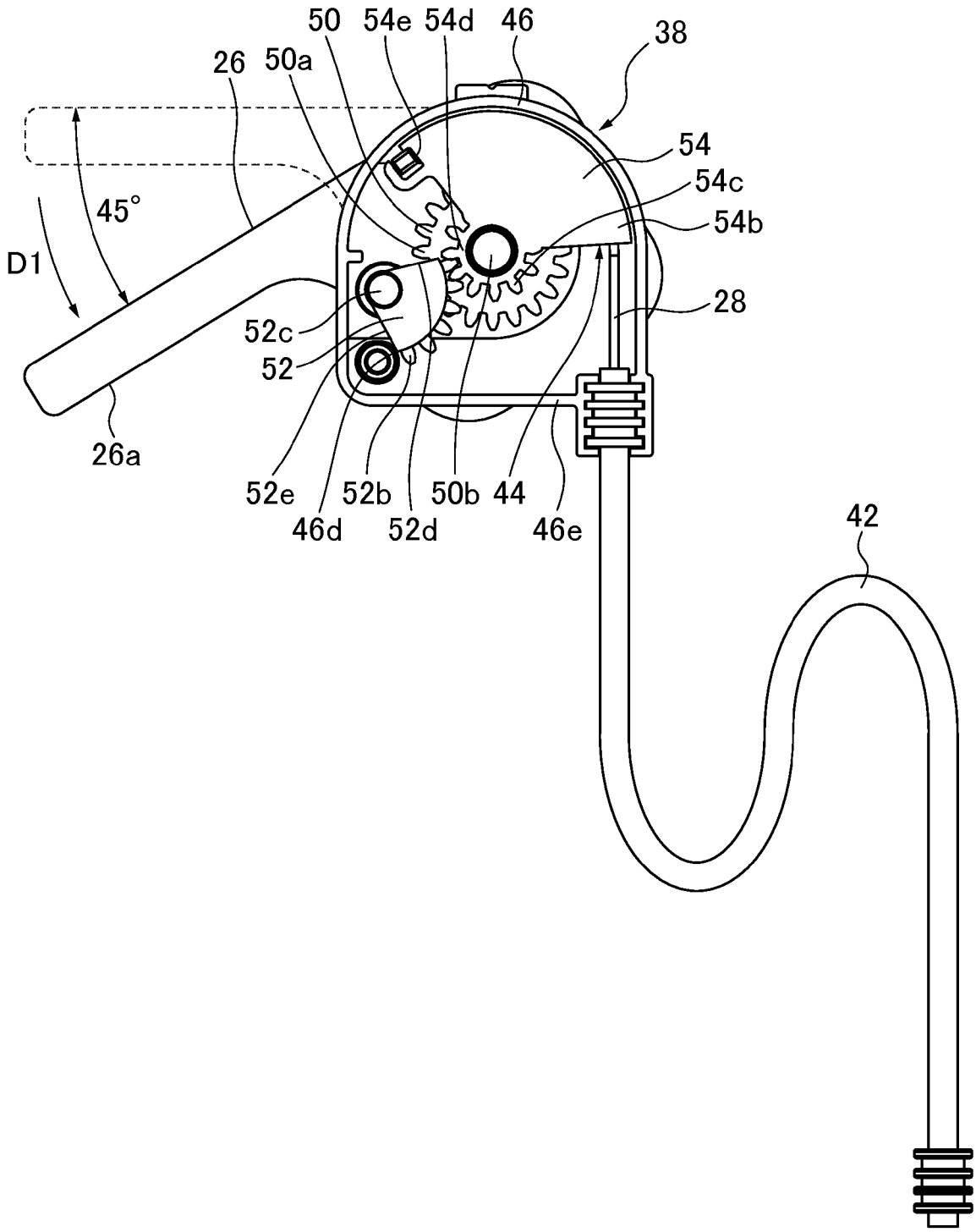
FIG. 9 is a front view illustrating the internal structure of the drive unit in a fully rotated state after the rotational operation of the operating member, in the operating device according to the first embodiment of the present invention, wherein the tube end on the water discharge device side is unconnected.

FIG. 7 is a front view illustrating the internal structure of the drive unit in a standby state just before rotational manipulation of an operating member, in the operating device according to the first embodiment of the present invention, wherein the tube end on the water discharge device side is unconnected. FIG. 8 is a front view illustrating the internal structure of the drive unit in a state during the rotational manipulation of the operating member, in the operating device according to the first embodiment of the present invention, wherein the tube end on the water discharge device side is unconnected. FIG. 9 is a front view illustrating the internal structure of the drive unit in a fully rotated state after the rotational operation of the operating member, in the operating device according to the first embodiment of the present invention, wherein the tube end on the water discharge device side is unconnected.

In FIG. 9, a position of the standby state just before rotational operation of the operating member is indicated by a dotted line for comparison.

As illustrated in FIG. 2, in a state just before start of water discharge by the water discharge valve device 24, the valve element (not illustrated) of the water discharge valve device 24 closes up the water discharge port 20, so that an initial water level within the flush water tank 18 becomes equal to the maximum water level WL (FIG. 2), and the float member 37 is located under flush water.

Then, as illustrated in FIGS. 2, 7 and 8, when a user starts the operation of the operating handle 26, the handling portion 26*a* of the operating handle 26 is rotated to be pulled downwardly by the user from the standby state of the operating handle 26. When the operating handle 26 is rotated, the rotary shaft 34 coupled to the operating handle 26 is rotated, and the first rotary gear member 50 attached to the rotary shaft 34 is in turn rotated. The operating handle 26 is rotated 45 degrees in a rotational direction D1 in which the handling portion 26*a* is pulled downwardly, which causes the rotary shaft 34 to be rotated 45 degrees in the same direction, and which in turn cause the first rotary gear member 50 to be rotated 45 degrees in the same direction.

When the first rotary gear member 50 is rotated in the rotational direction D1, the first tooth portion 50*a* of the first rotary gear member 50 is rotated in the rotational direction D1, and the outer second tooth portion 52*a* in mesh with the first tooth portion 50*a* is in turn rotated in a rotational direction D2 reverse of the rotational direction D1. When the first tooth portion 50*a* is rotated 45 degrees in the rotational direction D1, the outer second tooth portion 52*a* is rotated 75 degrees in the rotational direction D2. The inner second tooth portion 52*b* of the second rotary gear member 52 is rotated 75 degrees in the rotational direction D2 along with the rotation of the outer second tooth portion 52*a*.

When the inner second tooth portion 52*b* is rotated in the rotational direction D2, the roll-up member tooth portion 54*c* in mesh with the inner second tooth portion 52*b* is rotated in a rotational direction D3. In this process, while the inner second tooth portion 52*b* is rotated 75 degrees, the roll-up member tooth portion 54*c* is rotated 125 degrees. The rotary roll-up member 54 is configured such that when the roll-up member tooth portion 54*c* of the second outer peripheral portion 54*d* thereof is rotated, the first outer peripheral portion 54*b* thereof is rotated in the same rotational direction D3.

When the first outer peripheral portion 54*b* of the rotary roll-up member 54 is rotated in the rotational direction D3, the fixing portion 54*e* formed on the first outer peripheral portion 54*b* is rotated in a direction to be moved upwardly on an circumference of the rotary roll-up member 54 with the radius of rotation R1 (rotational direction D3). With the upward movement of the fixing portion 54*e* along with the rotation of the first outer peripheral portion 54*b*, the fixing portion 54*e* and the control wire 28 are pulled up in an arc above the rotary shaft 34. This cause the control wire 28 connected to the fixing portion 54*e* to be pulled up from the tube 42 and rolled up along the groove-like pulley portion 54*a* formed on an outer surface of the first outer peripheral portion 54*b*. The rotary roll-up member 54 is adapted to, when it is rotated 125 degrees from the start of rotation, allow the control wire 28 to be pulled up over a distance corresponding to an pull-up amount of the valve element (not illustrated) of the water discharge valve device 24, along the pulley portion 54*a* of the first outer peripheral portion 54*b*.

When the valve element of the water discharge valve device 24 is pulled up by the control wire 28, the water discharge valve device 24 operates to open the water discharge port 20 of the flush water tank 18 to start water discharge from the flush water tank assembly 16 to the toilet main unit 2 of the flush toilet 1 in the flushing mode, so that the water level within the flush water tank 18 starts being lowered. In the toilet main unit 2, flushing operation of waste in the toilet main unit 2 is performed by the discharged flush water.

When the water level within the flush water tank 18 is lowered and the float member 37 is moved downwardly, the flush water supply device 22 opens the water supply valve (not illustrated) to start supply of flush water into the flush water tank 18. In this process, when the user disengages his/her hand from the operating handle 26, the operating handle 26 is rotated to be returned to the standby state position based on a force of the spring 32. With the returning rotation of the operating handle 26, the rotation mechanism 44 of the drive unit 38 is also rotationally moved so that each component thereof is returned to the original standby state position as illustrated in FIG. 7. When the water level within the flush water tank 18 is lowered to the dead water level DWL, the water discharge valve device 24 operates to close the water discharge port 20 of the flush water tank 18. During the above process, the water supply to the water storage tank 18 is continuously performed through the flush water supply device 22. Thus, the water level within the flush water tank 18 is gradually raised from the dead water level DWL. Further, when the water level within the flush water tank 18 reaches the maximum water level WL at the time of full capacity of the flush water tank 18, the water supply valve (not illustrated) of the flush water supply device 22 is closed according to a command from the operating device (not illustrated) based on a signal from the float member 37 detecting the maximum water level WL within the flush water tank 18. Thus, the water supply of flush water from the flush water supply device 22 into the flush water tank 18 is stopped.

Next, with reference to FIGS. 7 and 10, a change of the drive unit of the operating device according to the first embodiment of the present invention will be described, wherein the drive unit can be changed from a drive unit attachable to the operating device attached to the left side of the flush water tank device as viewed from the front side to a right side drive unit attachable to the right side operating device attached to the right side of the flush water tank device as viewed from the front side, while using the same members of the rotation mechanism of the drive unit.

Figure 10:
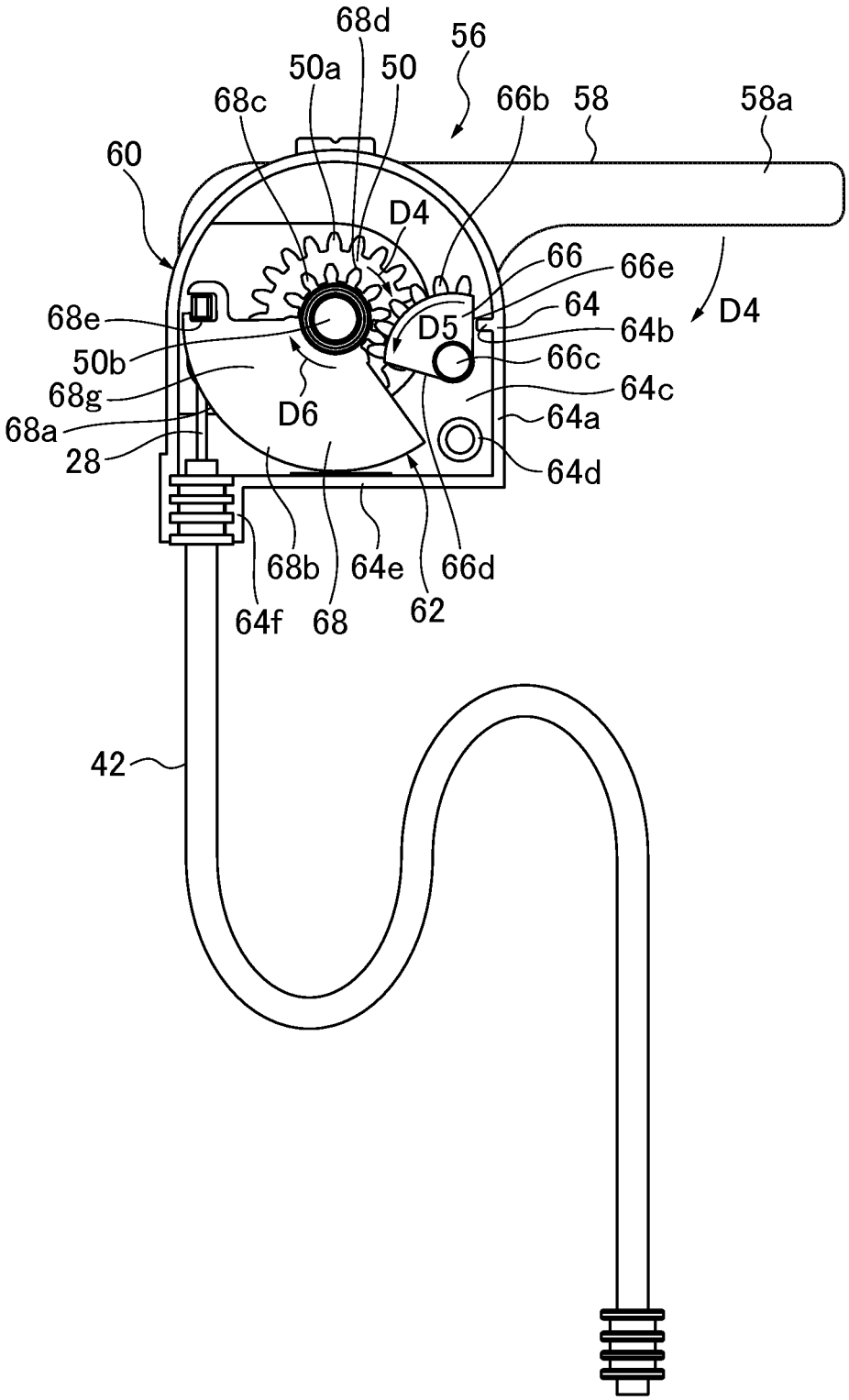
FIG. 10 is a front view illustrating an internal structure of a right side drive unit in a standby state just before rotational operation of a right side operating member, in the operating device according to the first embodiment of the present invention, wherein the tube end on the water discharge device side is unconnected.

FIG. 10 is a front view illustrating an internal structure of a right side drive unit in a standby state just before rotational operation of a right side operating member, in the operating device according to the first embodiment of the present invention, wherein the tube end on the water discharge device side is unconnected.

Firstly, if the operating device 30 attached to the left side of the flush water tank 18 is removed from the left side of the flush water tank 18 and attached to the right side of the flush water tank 18 directly, the handling portion 26*a* of the operating handle 26 operated by the user will be attached in an orientation facing a back side of the flush water tank 18, so that it becomes unavailable to the user. Therefore, the right side operating device 56 attached to the right side of the flush water tank 18 is required to be disposed such that a handling portion 58*a* of a right side operating handle 58 extends, on the right side of the flush water tank 18, to the front side of the flush water tank 18, and to comprise a right side drive unit 60 configured to displace the control wire 28 according to the rotational movement of the rotary shaft 34 in conformity to the rotation of the right side operating handle 58.

In FIG. 10, the right side drive unit 60 is formed by substantially the same components as the aforementioned drive unit 38 according to the first embodiment of the present invention. Thus, in the right side operating device 56, the same element or component as that in the operating device 30 is assigned with the same reference numeral or code, and the description thereof will be omitted.

The right side drive unit 60 comprises a right side rotation mechanism 62 configured to be rotated about the rotary shaft 34 based on a rotational force of the rotary shaft 34. The right side drive unit 60 further comprises a covering member 64 having a surrounding wall 64*a* rising toward an inward of the flush water tank 18 so as to cover the outer side of the right side rotation mechanism 62. The right side drive unit 60 further comprises a covering cap (not illustrated) configured to be combined with the covering member 64 in such a manner as to apply a cap from the inward of the flush water tank 18 thereby to form an outer periphery of the right side drive unit 60 together with the covering member 64.

The covering member 64 comprises a first restricting portion 64*b* formed on the surrounding wall 64*a* in a front surface inside the covering member 64, a second restricting portion 64*d* protruding from a basal wall 64*c* in a front region (on the front of the flush water tank 18) inside the covering member 64, and a tube attachment portion 64*f* for attaching the tube 42 to the rear (to the rear of the flush water tank 18) of a lower wall 64*e* of the covering member 64.

The right side rotation mechanism 62 of the right side drive unit 60 comprises a second rotary gear member 66 having an inner second tooth portion (not illustrated) formed in external teeth and meshable with the first tooth portion 50*a*. The right side rotation mechanism 62 further comprises a rotary roll-up member 68 meshable with the second rotary gear member 66 and configured to roll up the control wire 28 along its own rotational direction.

The second rotary gear member 66 comprises a rotational center shaft 66*c* for attaching the second rotary gear shaft 52*c* of the second rotary gear member 52 according to the first embodiment of the present invention in a frontward region of the right side rotation mechanism 62 of the right side drive unit 60. That is, the second rotary gear member 66 differs from the second rotary gear member 52 only in the position to be attached and the orientation thereof, and the same member is used. Thus, in this embodiment, the second rotary gear member 66 is provided using the second rotary gear member 52 by changing its position and orientation.

The second rotary gear member 66 is formed in a partial shape, and comprises a first cutout lateral surface 66*d* on one side of the partial shape, and a second cutout lateral surface 66*e* on the other side of the partial shape. The first cutout lateral surface 66*d* is allowed to come into contact with the second restricting portion 64*d* to thereby be restricted to prevent the second rotary gear member 66 from being rotated further toward the second restricting portion 64*d*. The second cutout lateral surface 66*e* is allowed to come into contact with the first restricting portion 64*b* to thereby be restricted to prevent the second rotary gear member 52 from being rotated further toward the first restricting portion 64*b*.

The rotary roll-up member 68 is provided by attaching the rotary roll-up member 54 according to the first embodiment of the present invention so as to be rotated about the same rotary shaft 34 (rotational support shaft 50*b*) while turning it over so that the fixing portion 54*e* is disposed at a laterally opposite position about the rotary shaft 34. That is, the rotary roll-up member 68 differs from the rotary roll-up member 54 only in that it is attached onto the rotational support shaft 50*b* so as to allow the front side 54*f* and the back side 54*g* of the rotary roll-up member 54 to be inverted, and is provided by the same member as the rotary roll-up member 54. Therefore, the rotary roll-up member 68 is adapted to be disposed by facing the front side (not illustrated) of the rotary roll-up member 68 to the outer side of the flush water tank 18 and the back side 68*g* (corresponding to the back side 54*g* of the rotary roll-up member 54) to the inner side of the flush water tank 18. Thus, the rotary roll-up member 68 can be provided using the rotary roll-up member 54.

By forming the right side rotation mechanism 62 of the right side drive unit 60 in this way, when the user performs the rotational operation for pulling the handling portion 58*a* of the right side operating handle 58 downwardly to be lowered 45 degrees in a rotational direction D4, the rotary shaft 34 coupled to the right side operating handle 58 is rotated 45 degrees in the rotational direction D4. This causes the first rotary gear member 50 attached to the rotary shaft 34 to be rotated 45 degrees in the rotational direction D4.

When the first rotary gear member 50 is rotated in the rotational direction D4, the outer second tooth portion 66*a* (not illustrated) in mesh with the first tooth portion 50*a* is rotated 75 degrees in a rotational direction D5, and the inner second tooth portion 66*b* is in turn rotated 75 degrees in the rotational direction D5. When the inner second tooth portion 66*b* is rotated in the rotational direction D5, a roll-up member tooth portion 68*c* in mesh with the inner second tooth portion 66*b* is rotated 125 degrees in a rotational direction D6. The rotary roll-up member 68 has a first outer peripheral portion 68*b* and a second outer peripheral portion 68*d*, wherein the second outer peripheral portion 68*d* is formed to have a curvature radius smaller than that of the first outer peripheral portion 68*b*.

Thus, the first outer peripheral portion 68*b* of the rotary roll-up member 68 is rotated 125 degrees in the rotational direction D6 to cause the control wire 28 connected to the fixing portion 68*e* to be pulled up from the tube 42 and rolled up along a groove-like pulley portion 68*a* formed on an outer surface of the first outer peripheral portion 68*b*. The rotary roll-up member 68 is adapted to, when it is rotated 125 degrees from the start of rotation, allow the control wire 28 to be pulled up over a distance corresponding to an pull-up amount of the valve element (not illustrated) of the water discharge valve device 24, along the pulley portion 68*a* of the first outer peripheral portion 68*b*.

In the operating device 30 according to the first embodiment of the present invention, with respect to the rotational movement of the operating handles 26, 58, the rotation mechanisms 44, 62 of the drive units 38, 60 are rotated at the radius of rotation R1 greater than the radius of rotation r1 of the rotary shaft 34. The rotation mechanisms 44, 62 are configured to roll up the control wire 28 along their own rotational directions D3, D6. This makes it possible to ensure that a control wire 28 is displaced to an amount sufficient to cause the water discharge valve to be moved upwardly and opened.

In addition, due to the configuration of the rotation mechanisms 44, 62 to roll up the control wire 28 along its their own rotational directions D3, D6, the entire length of the drive units 38, 60 in an up-down direction can be decreased more than ever before, so that the entire size of the drive units 38, 60 can be decreased. Therefore, the drive units 38, 60 can be disposed in a low-silhouette type of flush water tank 18 having a low height in an up-down direction. Thus, when the drive units 38, 60 are disposed in the low-silhouette type of flush water tank 18, they are not located under a water level of flush water at the maximum water level WL stored in the flush water tank 18. This prevents generation of rust, scale, or the like on the control wire 28 to enable a stable operation of the operating device 30 comprising the control wire 28.

Further, in the operating device 30 according to the first embodiment of the present invention, the rotation mechanisms 44, 62 of the drive units 38, 60 are configured to allow the first tooth portion 50*a* rotated in interlocking relation to the rotary shaft 34 to be rotated in mesh with the second tooth portion (inner second tooth portions 52*b*, 66*a*). The second tooth portions (inner second tooth portions 52*b*, 66*a*) are rotated in mesh with the roll-up member tooth portions 54*c*, 68*c*, respectively. Thus, the rotary roll-up members 54, 68 are rotated in accordance with a rotational amount transmitted and amplified through the teeth, and configured to roll up the control wire 28 in their own rotational directions D3, D6 from the fixing portions 54*e*, 68*e* along the outer periphery thereof. This makes it possible to ensure that the control wire 28 is displaced to an amount sufficient to cause a water discharge valve to be moved upwardly and opened even with a relatively small rotational movement of the operating handles 26, 58.

Therefore, due to the configuration of the rotary roll-up members 54, 68 to roll up the control wire 28 in their own rotational directions D3, D6 along the outer periphery thereof, the entire length of the drive units 38, 60 in an up-down direction can be decreased more than ever before, so that the entire size of the drive units 38, 60 can be decreased. Therefore, the drive units 38, 60 can be disposed in a low-silhouette type of flush water tank 18 having a low height in an up-down direction. Further, the drive units 38, 60 are not located under a water level of flush water at the maximum water level WL stored in the flush water tank 18 when they are disposed in the low-silhouette type of flush water tank 18. This prevents generation of rust, scale, or the like on the control wire 28 to enable a stable operation of the operating device 30 comprising the control wire 28.

Further, in the operating device 30 according to the first embodiment of the present invention, the rotary roll-up members 54, 68 are configured such that the rotational center shaft 50*b* has an axis C identical to that of the rotary shaft 34 to which the first rotary gear member 50 is attached. Thus, the rotary roll-up members 54, 68 can be rotated in an area that is bilaterally symmetric about the axis C of the rotational center shaft 50*b*. This makes it possible to cause the a rotational movement area in which the rotary roll-up members 54, 68 are permitted to make a rotational movement to be formed smaller, and to ensure that the control wire 28 is displaced to an amount sufficient to cause a water discharge valve to be moved upwardly and opened.

Therefore, the entire size of the drive units 38, 60 can be further decreased, and the drive units 38, 60 can be disposed in a low-silhouette type of flush water tank 18 having a low height in an up-down direction. Thus, when the drive units 38, 60 are disposed in the low-silhouette type of flush water tank 18, they are not located under a water level of flush water at the maximum water level WL stored in the flush water tank 18. This prevents generation of rust, scale, or the like on the control wire 28 to enable a stable operation of the operating device 30 comprising the control wire 28.

Further, in the operating device 30 according to the first embodiment of the present invention, the rotary roll-up members 54, 68 are formed to allow the first outer peripheral portions 54*b*, 68*b* formed to have a relatively large curvature radius and the second outer peripheral portions 54*d*, 68*d* formed to have a curvature radius smaller than that of the first outer peripheral portions 54*b*, 68*b* to be rotated about the same rotational center shaft 50*b*. Thus, The rotary roll-up members 54, 68 allow the first outer peripheral portions 54*b*, 68*b* configured to roll up the control wire 28 fixed to the fixing portions 54*e*, 68*e* and the second outer peripheral portions 54*d*, 68*d* having the roll-up member tooth portions 54*c*, 68*c* configured to be meshable with the inner second tooth portions 52*b*, 66*b* to be rotated about the same rotational center shaft 50*b*. Therefore, the first outer peripheral portions 54*b*, 68*b* and the second outer peripheral portions 54*d*, 68*d* can be formed on the same plane. This makes it possible to form the rotary roll-up members 54, 68 to have a small thickness as compared to the case where the first outer peripheral portions 54*b*, 68*b* and the second outer peripheral portions 54*d*, 68*d* are not formed on the same plane, so that the size of the rotary roll-up members 54, 68 themselves can be decreased.

Further, in the operating device 30 according to the first embodiment of the present invention, the partially-shaped first cutout lateral surface 52*d* and the first restricting portion 46*b* are allowed to come into contact with each other (or the partially-shaped first cutout lateral surface 66*d* and the second restricting portion 64*d* are allowed to come into contact with each other). Further, the second cutout lateral surface 52*e* and the second restricting portion 46*d* are allowed to come into contact with each other (or the second cutout lateral surface 66*e* and the first restricting portion 64*b* are allowed to come into contact with each other). This configuration restricts a range in which a user is permitted to perform the rotational operation of the operating handles 26, 58. This eliminates the need for newly providing any restriction means for restricting a range in which a user is permitted to perform the rotational manipulation of the operating handles 26, 58, so that the entire size of the drive units 38, 60 can be further decreased.

Further, the second rotary gear members 52, 66 are formed in a partial shape smaller than a semicircle, so that the size thereof can be decreased. Thus, the size of the covering members 46, 64 covering the rotation mechanisms 44, 62 comprising the second rotary gear members 52, 66 can be decreased, so that the entire size of the drive units 38, 60 can be further decreased.

Further, in the operating device 30 according to the first embodiment of the present invention, the drive units 38, 60 are configured to allow an arrangement of the second rotary gear members 52, 66 and the rotary roll-up members 54, 68 of the rotation mechanisms 44, 62 to be changed, whereby the drive units 38, 60 can be attached to the operating handles 26, 58, irrespective of whether the operating handles 26, 58 are attached to a left lateral region 18*a* or a right lateral region 18*b* of the outer surface of the flush water tank 18. Thus, it becomes possible to provide the operating device 30 attachable to either of a left lateral region or a right lateral region of the flush water tank 18.

According to a second aspect of the present invention, there is provided a flush water tank assembly 18 comprising the above operating device 30.

In the second aspect of the present invention, a flush water tank assembly 18 comprising the above operating device 30 can be provided.

According to a third aspect of the present invention, there is provided a flush toilet 1 comprising the above flush water tank assembly 18.

In the third aspect of the present invention, a flush toilet 1 comprising the above flush water tank assembly 18 can be provided.

Next, with reference to FIGS. 11 to 14, an operating device according to the second embodiment of the present invention will be described.

Figure 11:
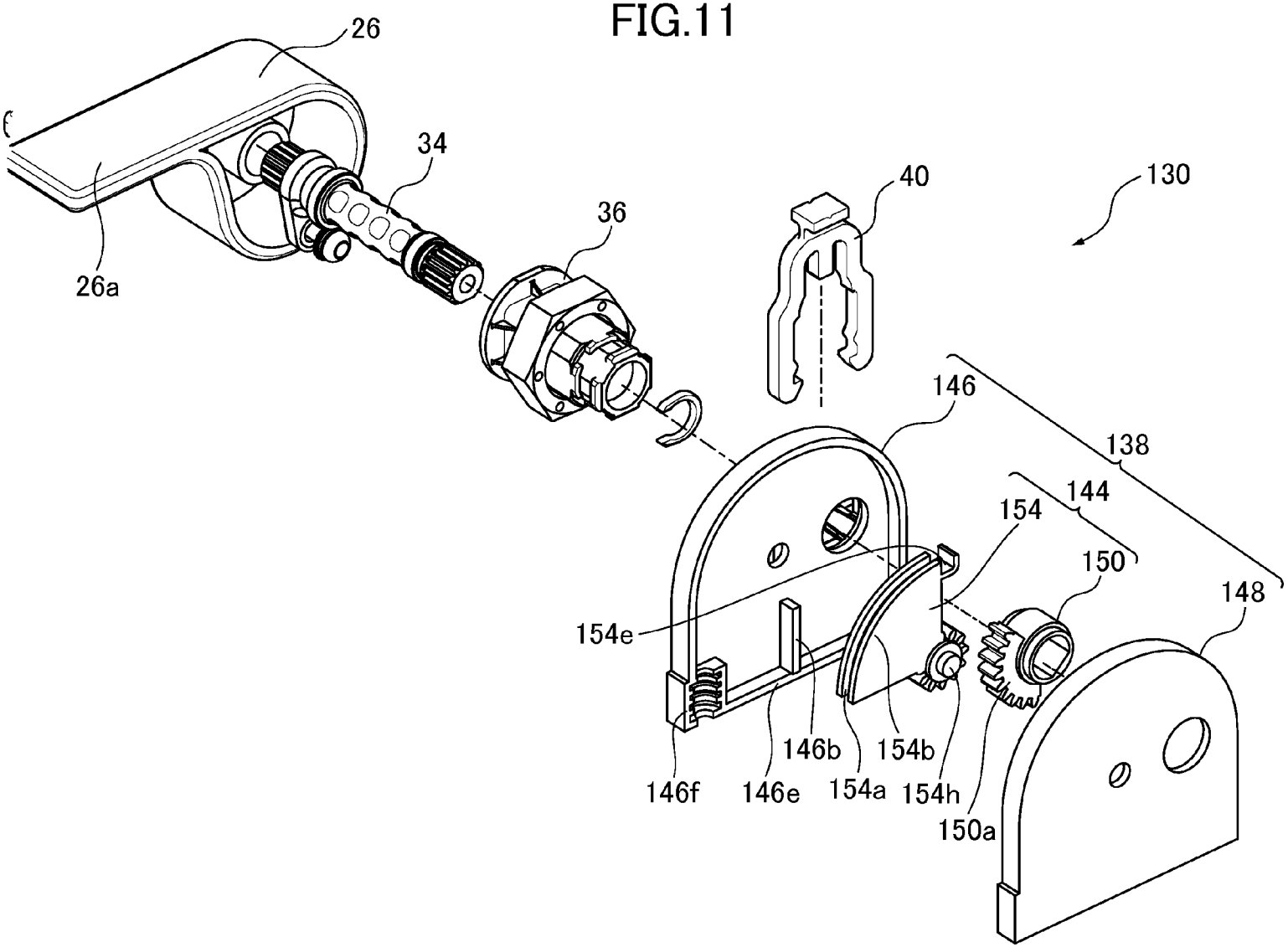
FIG. 11 is an exploded perspective view illustrating an operating device according to a second embodiment of the present invention.
Figure 12:
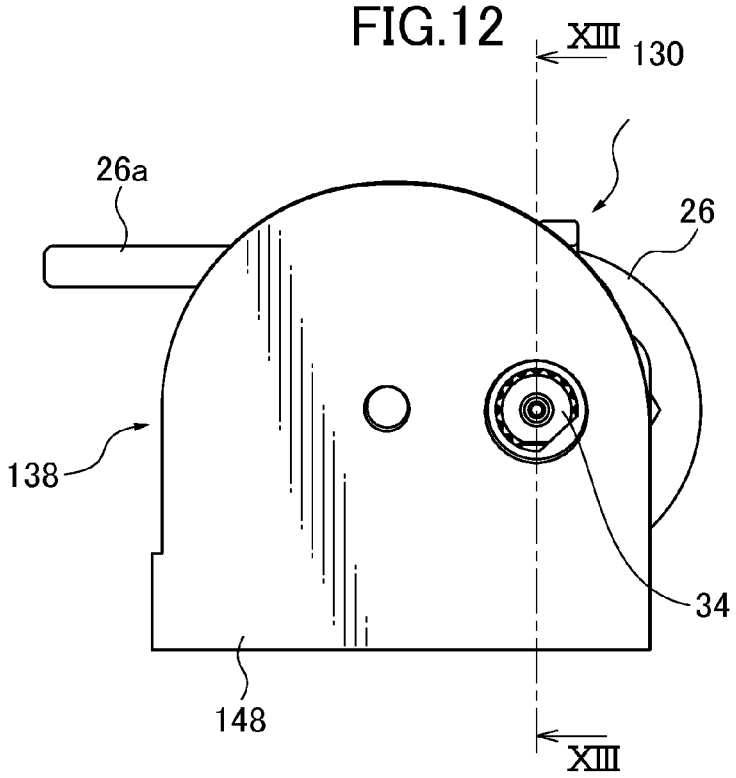
FIG. 12 is a plane perspective view illustrating the operating device according to the second embodiment of the present invention.
Figure 13:
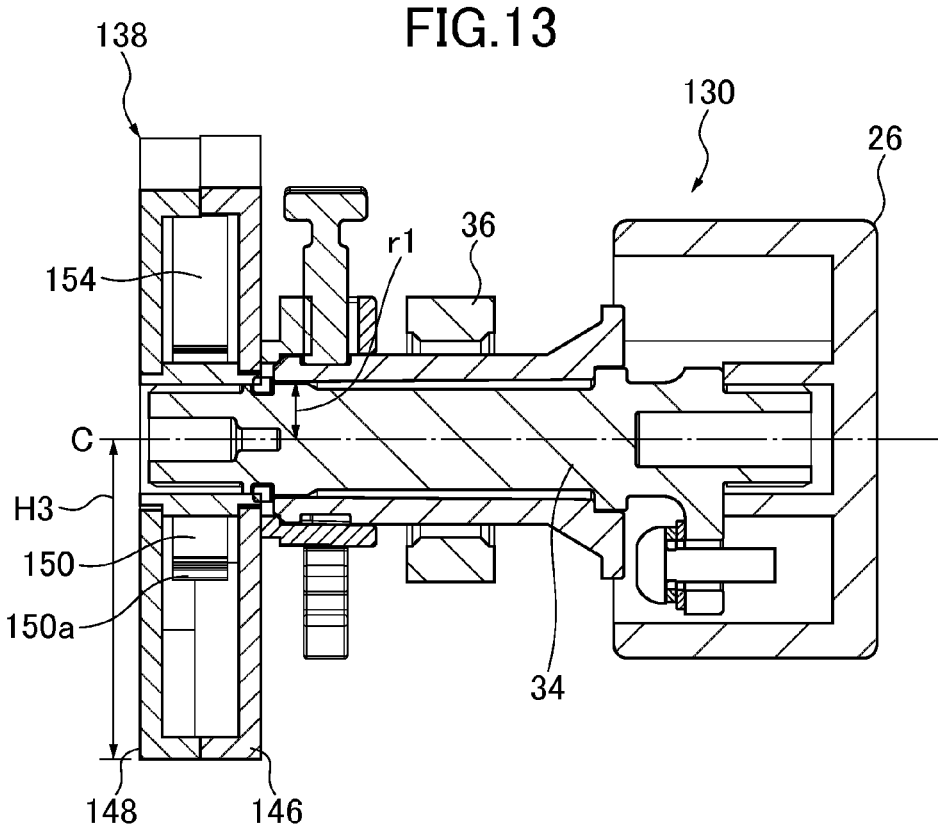
FIG. 13 is a sectional view taken along the line XIII-XIII in FIG. 12.
Figure 14:
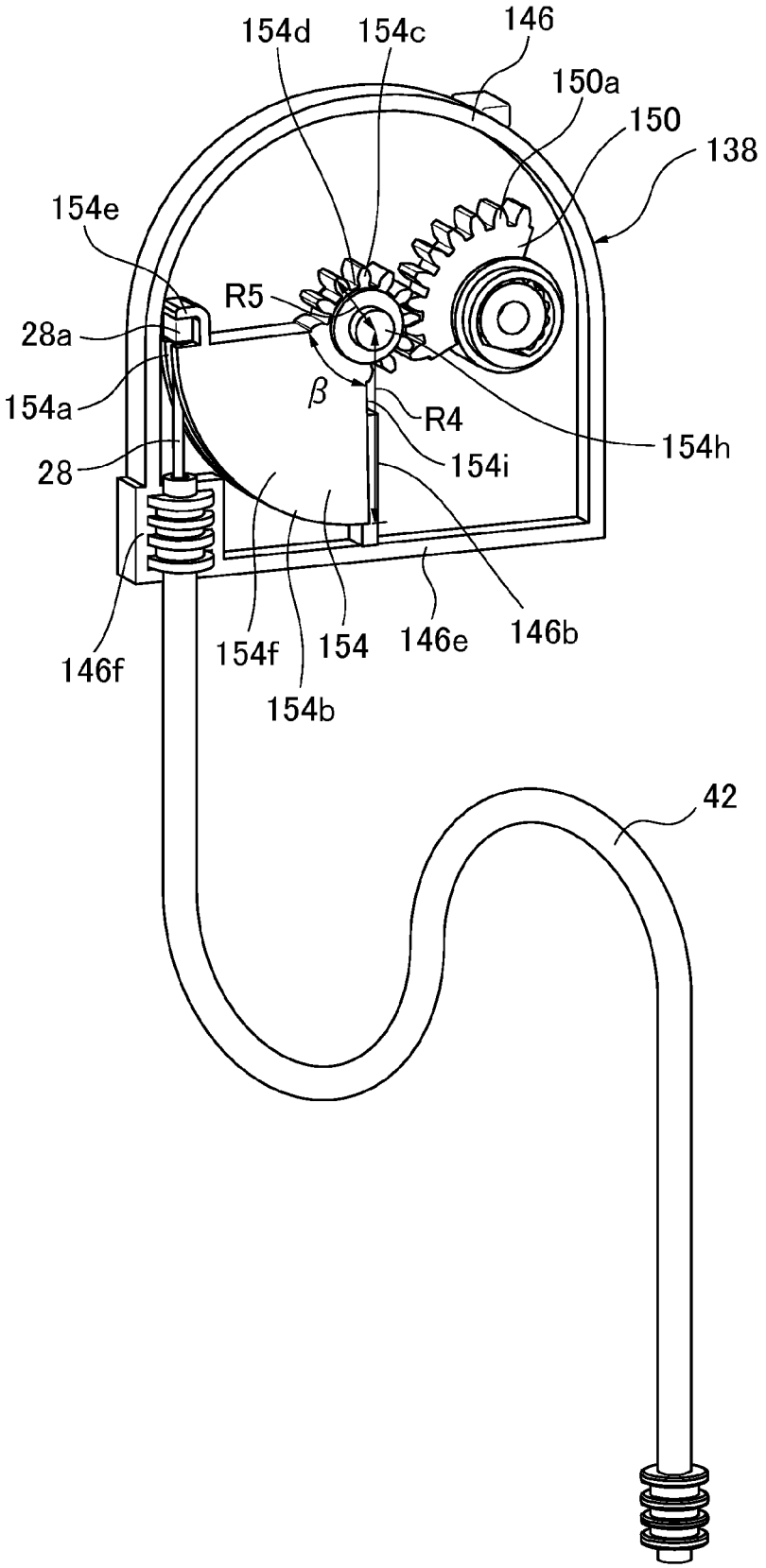
FIG. 14 is a perspective view illustrating an internal structure of a drive unit in a standby state just before rotational operation of an operating member, in the operating device according to the second embodiment of the present invention, wherein a tube end on the water discharge device side is unconnected.

FIG. 11 is an exploded perspective view illustrating an operating device according to a second embodiment of the present invention. FIG. 12 is a plane perspective view illustrating the operating device according to the second embodiment of the present invention. FIG. 13 is a sectional view taken along the line XIII-XIII in FIG. 12. FIG. 14 is a perspective view illustrating an internal structure of a drive unit in a standby state just before rotational operation of an operating member, in the operating device according to the second embodiment of the present invention, wherein a tube end on the water discharge device side is unconnected.

In FIGS. 11 to 14, the same element or component as that in the foregoing operating device according to the first embodiment of the present invention is assigned with the same reference numeral or code, and its description will be omitted.

In the operating device according to the second embodiment of the present invention, only the configuration of the drive unit is different from that of the operating device according to the first embodiment of the present invention, and the other elements have the same configuration as those in the first embodiment. Thus, only the drive unit having a different configuration from the first embodiment will be described below.

As illustrated in FIGS. 11 to 14, in the drive unit of the operating device according to the second embodiment of the present invention, no component is disposed which corresponds to the foregoing second rotary gear member of the drive unit of the operating device according to the first embodiment of the present invention.

Firstly, the operating device 130 according to the second embodiment of the present invention comprises a drive unit 138 disposed above the maximum water level WL of flush water within the flush water tank 18, and configured to transmit the rotational movement of the rotary shaft 34 to roll up the control wire 28. The rotary shaft 34 is connected to the drive unit 138 in a rearward region from the central region of the drive unit 138 inside the flush water tank 18.

The drive unit 138 comprises a rotation mechanism 144 configured to be rotated about the rotary shaft 34 based on a rotational force of the rotary shaft 34. The drive unit 138 further comprises a covering member 146 having a surrounding wall 146*a* rising toward an inward of the flush water tank 18 so as to cover the outer side of the rotation mechanism 144. The drive unit 138 further comprises a covering cap 148 configured to be combined with the covering member 146 in such a manner as to apply a cap from the inward of the flush water tank 18 thereby to form an outer periphery of the drive unit 138 together with the covering member 146.

The rotation mechanism 144 is configured to be rotated at a curvature radius (radius of rotation) R4 larger than a curvature radius (radius of rotation) r1 of the rotary shaft 34. The covering member 146 comprises a first restricting portion 146*b* formed to extend upwardly from a lower wall 146*e* within the covering member 146, and a tube attachment portion 146*f* for attaching the tube 42 to a frontward region of the lower wall 146*e*.

The operating device 130 according to the second embodiment of the present invention is an operating device attached to the left lateral region 18*a* of the flush water tank 18 so as to facilitate the operation of the user with his/her left hand. Alternatively, the operating device 130 may be an operating device attached to the right lateral region 18*b* of the flush water tank 18 so as to facilitate the manipulation of the user with his/her right hand.

Next, with reference to FIGS. 11 to 14, the rotation mechanism of the drive unit of the operating device according to the second embodiment of the present invention will be described in more detail below.

The rotation mechanism 144 of the drive unit 138 comprises a first rotary gear member 150 attached to the rotary shaft 34 to be interlockingly rotated with the rotary shaft 34, and having a first tooth portion 150*a* formed with external teeth. The rotation mechanism 44 further comprises a rotary roll-up member 154 meshable with the first rotary gear member 150 and configured to roll up the control wire 28 along its own rotational direction.

As described above, the first rotary gear member 150 has the first tooth portion 150*a* formed on a part of an outer periphery thereof to form a partially-shaped (fan-like shaped) gear. In order to be rotated with the rotary shaft 34, the first rotary gear member 150 is disposed such that the rotary shaft 34 is attached thereto in such a manner as to be fitted in a central region of the first rotary gear member 150 and the first rotary gear member 150 is rotated about the rotational axis C of the rotary shaft 34. Since the first rotary gear member 150 is rotated with the rotary shaft 34, in this embodiment, when the operating handle 26 is rotationally operated 45 degrees, then the rotary shaft 34 is rotated 45 degrees, and the first rotary gear member 150 is rotated 45 degrees.

The rotary roll-up member 154 comprises: a first outer peripheral portion 154*b* formed as a pulley portion 154*a* having a length of about one-quarter of entire circumference of the rotary roll-up member 154, and configured to roll up the control wire 28 along its own rotational direction; and a second outer peripheral portion 154*d* formed in a fan-like shape as a roll-up member tooth portion 154*c* having a length of about three-quarter of the entire circumference. In the second outer peripheral portion 154*d*, the roll-up member tooth portion 154*c* is formed in external teeth so as to meshable with the first tooth portion 150*a*. The rotary roll-up member 154 further comprises a fixing portion 154*e* formed on an upper end of the circumference on the first outer peripheral portion 154*b*, and configured to fix the control wire 28 while allowing the control wire 28 to extend along the first outer peripheral portion 154*b*.

The rotary roll-up member 154 is configured to have a rotary shaft that is different from the rotary shaft 34 to which the first rotary gear member 150 is attached, as a rotational support shaft 154*h* supporting the rotation of the rotary roll-up member 154. The rotary shaft 34 is disposed apart from the central region of the covering member 146, while the rotational support shaft 154*h* is disposed in substantially the central region of the covering member 146. This arrangement allows the rotary roll-up member 154 to be rotated about the rotational support shaft 154*h*, so that the outer shape of the covering member 146 defining an outer edge of great majority of an area in which the rotation mechanism 144 is permitted to be rotated can be formed to have a relatively small size. This makes it possible to suppress enlargement of the length in right-left and up-down directions of the drive unit 138 to thereby further decrease the entire size of the drive unit 138. The rotational support shaft 154*h* is disposed on the same level in the horizontal direction as the rotary shaft 34.

In the rotary roll-up member 154, the first outer peripheral portion 154*b* is formed to have a relatively large curvature radius (radius of rotation) R4, and the second outer peripheral portion 154*d* is formed to have a curvature radius (radius of rotation) R5 smaller than the curvature radius (radius of rotation) R4 of the first outer peripheral portion 154*b*.

An outer edge of great majority of an area in which the first rotation mechanism 144 is permitted to be rotated is defined by an area in which the first outer peripheral portion 154*b* is permitted to be rotated. The covering member 146 can substantially be formed to have an outer shape covering a circular region with radius of rotation R4. Further, the covering member 146 can have the lower wall 146*e* of the covering member 146 formed at a position below the rotational support shaft 154*h* in an up-down direction by a distance slightly longer than the curvature radius R4 of the first outer peripheral portion 154*b*.

In this case, the drive unit 138 is formed to have an entire length in an up-down direction shorter than ever before. Specifically, the drive unit 138 is formed to have a height H3 in an up-down direction from the rotational axis C of the rotary shaft 34 to the lower wall 146*e* smaller than the height H1 in an up-down direction between the rotational axis C and the maximum water level WL.

In this embodiment, when the first rotary gear member 150 is rotationally moved 45 degrees, the roll-up member tooth portion 154*c* is rotated in accordance with an amplified rotational amount of 90 degrees, so that the rotary roll-up member 154 is rotated 90 degrees about the rotational support shaft 154*h*.

The pulley portion 154*a* of the rotary roll-up member 154 is formed in a groove-like shape that is radially-inwardly concaved along the first outer peripheral portion 154*b*. This makes it possible to cause the control wire 28 to be rolled up along the pulley portion 154*a* while being fitted in the groove-like pulley portion 154*a*.

The fixing portion 154*e* is continuously provided from the groove on an upper end of the pulley portion 154*a* of the rotary roll-up member 154. In the front view illustrated in FIG. 15, it is formed in a C-shape opening toward the outside of the rotary roll-up member 154. Thus, the fixing portion 154*e* is adapted to fix the control wire 28 by causing a drive unit-side end 28*a* of the control wire 28 to be fitted in the C-shaped fixing portion, while allowing the control wire 28 to be directed to the outer periphery of the rotary roll-up member 154 so that it can extend along the pulley portion 154*a*. Further, the rotary roll-up member 154 is adapted, when the rotation mechanism 144 of the drive unit 138 is connected via the rotary shaft 34 to the operating handle 26 disposed on the left lateral region 18*a* of the flush water tank 18, to be disposed by causing a front side 154*f* of the rotary roll-up member 154 to be faced to the inner side of the flush water tank 18, and a back side 154*g* (not illustrated) to be faced to the outer side of the flush water tank 18. The rotary roll-up member 154 is formed such that an angle β of the fan-like shape has a measure that allows the control wire 28 to be reliably rolled up along the first outer peripheral portion 154*b* to an amount of displacement for causing a water discharge valve to be sufficiently moved upwardly by causing the rotary roll-up member 154 having the curvature radius R4 to be rotated to the angle f3.

As described above, the first tooth portion 150*a* and the roll-up member tooth portion 154*c* are configured to have a gear ratio enabling a rotation angle of the rotary roll-up member 154 to be increased to an angle that allows the control wire 28 to be reliably displaced to an amount sufficient to open and close the water discharge valve. The gear ratio of the first tooth portion 150*a* and the roll-up member tooth portion 154*c* can be changed.

The pulley portion 154*a* of the rotary roll-up member 154 is formed in a partial shape, so that it has a first cutout lateral surface 154*i* on a lateral surface opposite the fixing portion 154*e* in the partial shape. The first cutout lateral surface 154*i* is allowed to come into contact with the first restricting portion 146*b* to thereby be restricted to prevent the rotary roll-up member 154 from being rotated further toward the first restricting portion 146*b*. Thus, by restricting the range of rotation of the rotary roll-up member 154, the range of magnitude in which the control wire 28 is permitted to be displaced can be restricted.

Next, with reference to FIGS. 15 to 17, operations (functions) of the operating device according to the second embodiment of the present invention, a flush water tank assembly equipped with the operating device, and a flush toilet equipped with the flush water tank assembly, will now be described.

Figure 15:
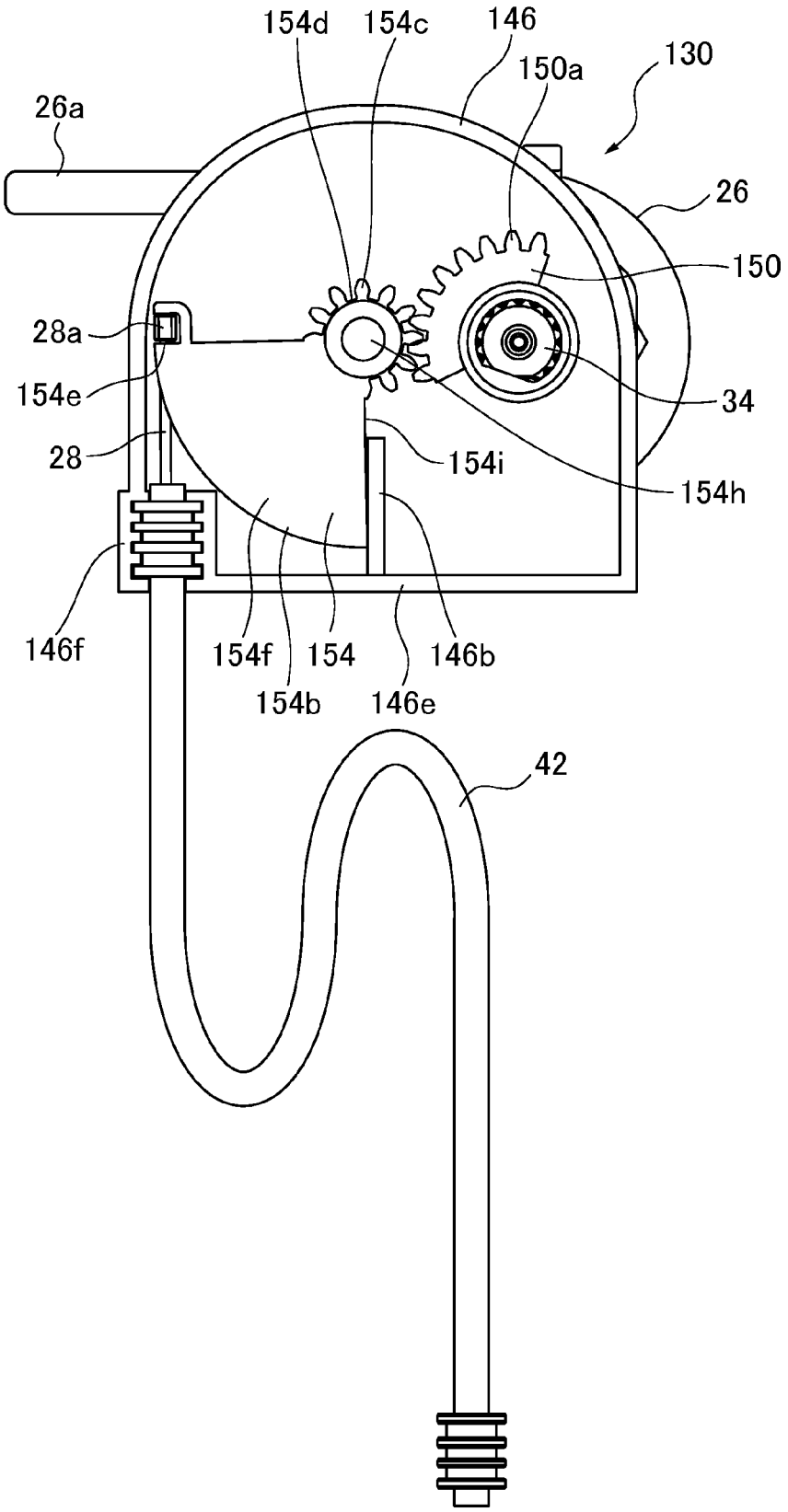
FIG. 15 is a front view illustrating the internal structure of the drive unit in the standby state just before rotational operation of the operating member, in the operating device according to the second embodiment of the present invention, wherein the tube end on the water discharge device side is unconnected.

FIG. 15 is a front view illustrating the internal structure of the drive unit in the standby state just before rotational operation of the operating member, in the operating device according to the second embodiment of the present invention, wherein the tube end on the water discharge device side is unconnected. FIG. 16 is a front view illustrating the internal structure of the drive unit in a state during the rotational operation of the operating member, in the operating device according to the second embodiment of the present invention, wherein the tube end on the water discharge device side is unconnected. FIG. 17 is a front view illustrating the internal structure of the drive unit in a fully rotated state after the rotational manipulation of the operating member, in the operating device according to the second embodiment of the present invention, wherein the tube end on the water discharge device side is unconnected.

The operations of the flush water tank assembly and the flush toilet equipped with the flush water tank assembly other than the operation of the operating device according to the second embodiment of the present invention are identical to the operations of the flush water tank assembly equipped with the operating device according to the first embodiment of the present invention and the flush toilet equipped with the flush water tank assembly, so that the description thereof will be omitted.

Figure 16:
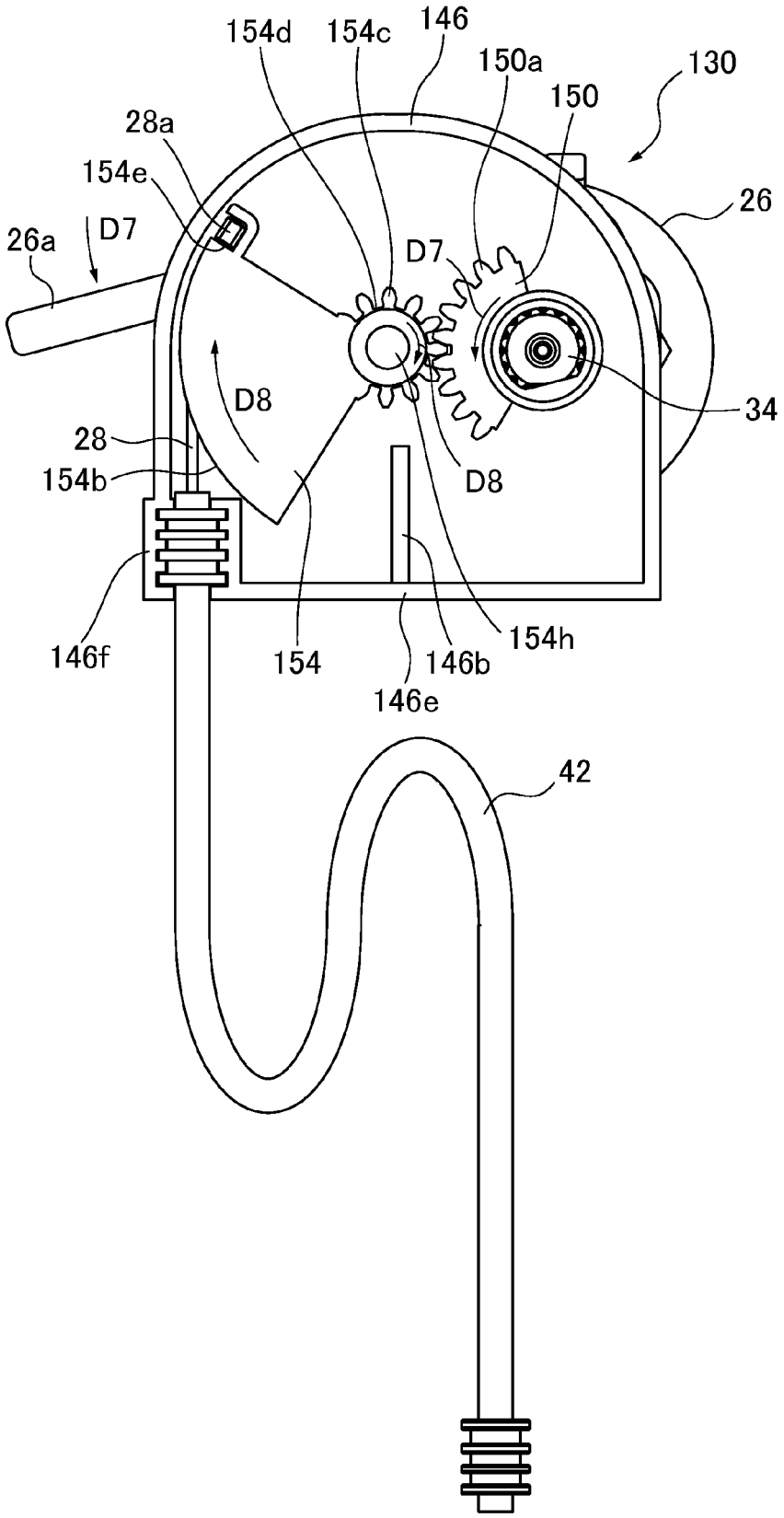
FIG. 16 is a front view illustrating the internal structure of the drive unit in a state during the rotational operation of the operating member, in the operating device according to the second embodiment of the present invention, wherein the tube end on the water discharge device side is unconnected.
Figure 17:
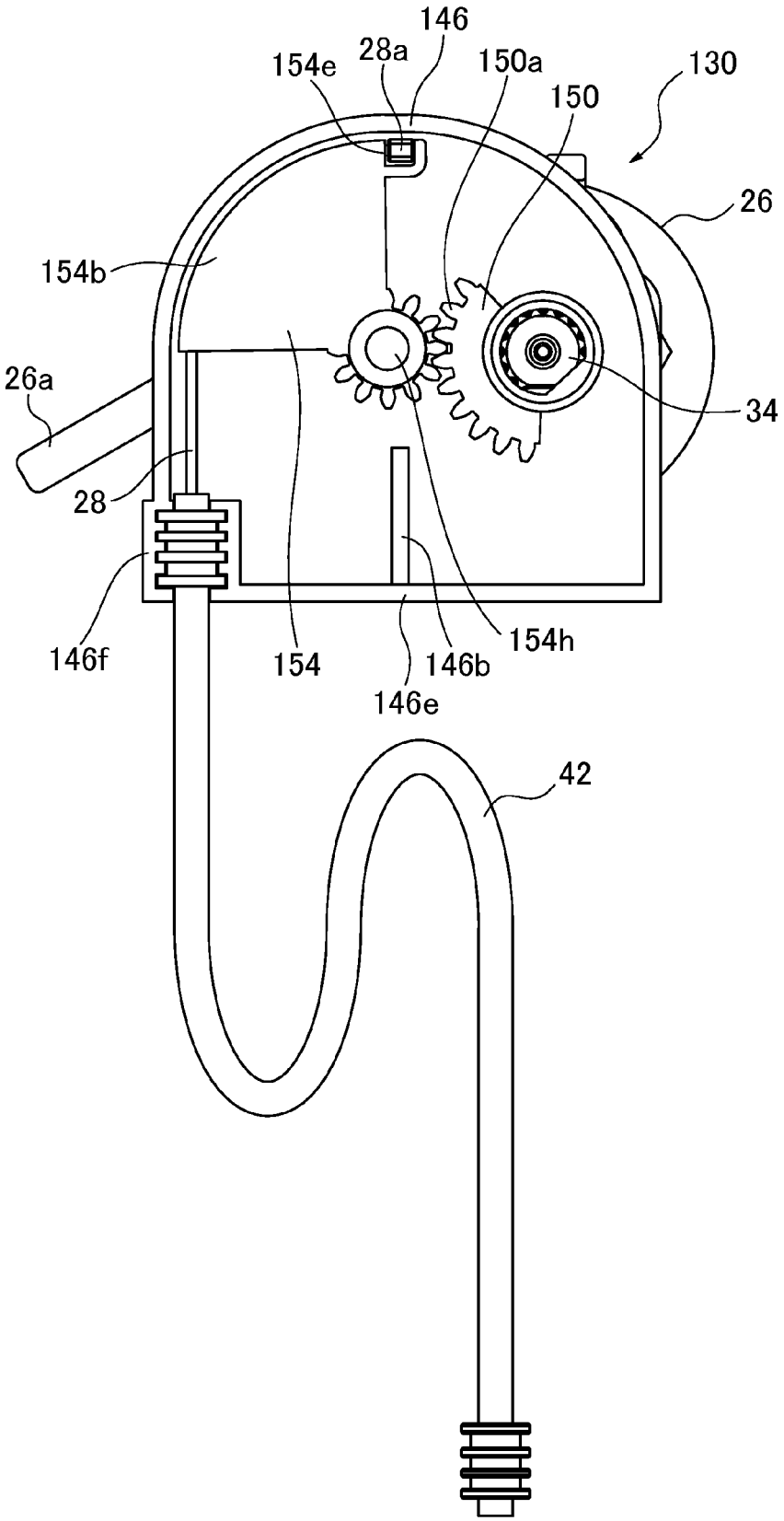
FIG. 17 is a front view illustrating the internal structure of the drive unit in a fully rotated state after the rotational operation of the operating member, in the operating device according to the second embodiment of the present invention, wherein the tube end on the water discharge device side is unconnected.
Figure 18:
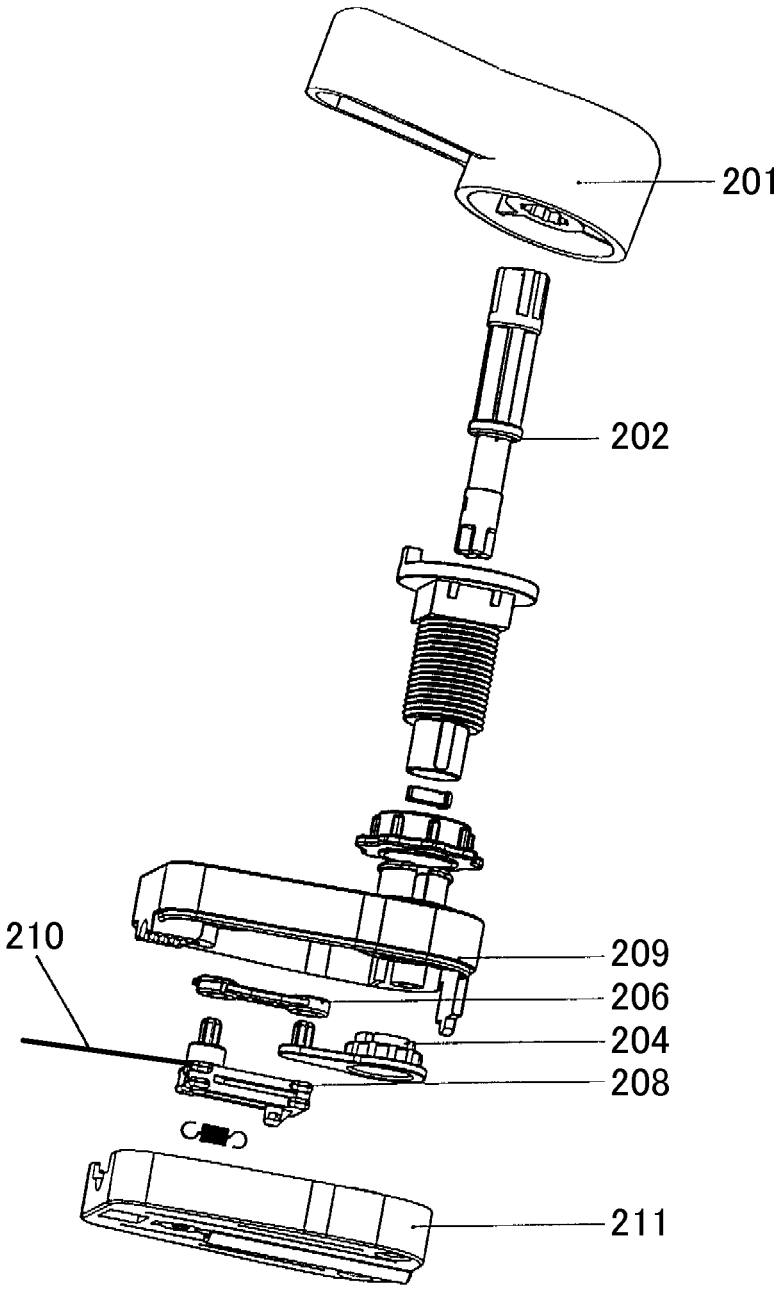
FIG.18 PRIOR ART
FIG. 18 is an exploded perspective view illustrating a conventional operating device for water discharge of a water tank.
Figure 19:
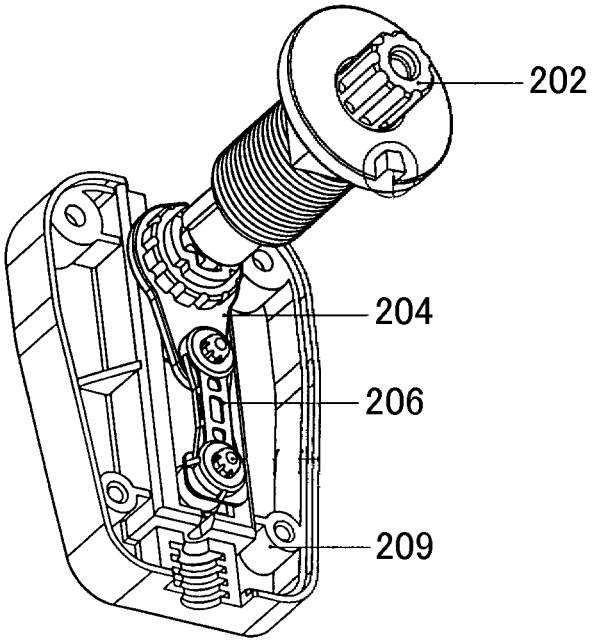
FIG.19 PRIOR ART
FIG. 19 is a perspective view illustrating the conventional operating device for water discharge of the water tank.

As illustrated in FIGS. 15 to 17, the user rotates the operating handle 26 so as to pull it downwardly. When the operating handle 26 is rotated, the rotary shaft 34 coupled to the operating handle 26 is rotated, and the first rotary gear member 150 attached to the rotary shaft 34 is in turn rotated. The operating handle 26 is rotated 45 degrees in the rotational direction D7 in which the handling portion 26*a* is pulled downwardly. This causes the rotary shaft 34 to be rotated 45 degrees in the same rotational direction D7, which in turn causes the first rotary gear member 150 to be rotated 45 degrees in the same rotational direction D7.

When the first rotary gear member 150 is rotated in the rotational direction D7, the first tooth portion 150*a* of the first rotary gear member 150 is rotated in the rotational direction D7, and the roll-up member tooth portion 154*c* in mesh with the first tooth portion 150*a* is in turn rotated in the rotational direction D8 reverse of the rotational direction D7. In this process, when the first tooth portion 150*a* is rotated 45 degrees in the rotational direction D7, the roll-up member tooth portion 154*c* is rotated 90 degrees in the rotational direction D8. The first outer peripheral portion 154*b* of the rotary roll-up member 154 is rotated 90 degrees in the rotational direction D8 along with the rotation of the roll-up member tooth portion 154*c*.

When the first outer peripheral portion 154*b* of the rotary roll-up member 154 is rotated in the rotational direction D8, the fixing portion 154*e* formed on the first outer peripheral portion 154*b* is rotated in a direction to be moved upwardly on an circumference with the radius of rotation R4 (rotational direction D8) about the rotational support shaft 154*h* of the rotary roll-up member 154. With the upward movement of the fixing portion 154*e* along with the rotation of the first outer peripheral portion 154*b*, the fixing portion 154*e* and the control wire 28 are pulled up in an arc above the rotary shaft 34. This cause the control wire 28 connected to the fixing portion 154*e* to be pulled out from the tube 42 and rolled up along the groove-like pulley portion 154*a* formed on an outer surface of the first outer peripheral portion 154*b*. The rotary roll-up member 154 is adapted, when it is rotated 90 degrees from the start of rotation, to allow the control wire 28 to be pulled up over a distance corresponding to an pull-up amount of the valve element (not illustrated) of the water discharge valve device 24, along the pulley portion 154*a* of the first outer peripheral portion 154*b*. When the user disengages his/her hand from the operating handle 26, the operating handle 26 is rotated to be returned to the standby state position based on a force of the spring (not illustrated). With the returning rotation of the operating handle 26, the rotation mechanism 144 of the drive unit 138 is also rotationally moved so that each component thereof is returned to the original standby state position as illustrated in FIG. 15.

In the foregoing operating device 130 according to the second of the present invention, the rotation mechanism 144 of the drive unit 138 is configured to allow the first tooth portion 150*a* rotated in interlocking relation to the rotary shaft 34 to be rotated in mesh with the roll-up member tooth portion 154*c*. Thus, the rotary roll-up member 154 is rotated in accordance with a rotational amount transmitted and amplified through the teeth, and configured to roll up the control wire 28 in its own rotational direction from the fixing portion 154*e* along the outer periphery thereof. This makes it possible to ensure that the control wire 28 is displaced to an amount sufficient to cause a water discharge valve to be moved upwardly and opened even with a relatively small rotational movement of the operating handle 26.

Therefore, due to the configuration of the rotary roll-up member 154 to roll up the control wire 28 in its own rotational directions along the outer periphery thereof, the entire length of the drive unit 138 in an up-down direction can be decreased more than ever before, so that the entire size of the drive unit 138 can be decreased. Therefore, the drive unit 138 can be disposed in a low-silhouette type of flush water tank 18 having a low height in an up-down direction. Thus, when the drive unit 138 is disposed in the low-silhouette type of flush water tank 18, it is not located under a water level of flush water at the maximum water level WL stored in the flush water tank 18. This prevents generation of rust, scale, or the like on the control wire 28 to enable a stable operation of the operating device 130 comprising the control wire 28.

Further, in the operating device 130 according to the second of the present invention, the rotary roll-up member 154 comprises a fixing portion 154*e* for fixing the control wire 28, provided on the first outer peripheral portion 154*b* having a relatively large curvature radius, whereby the control wire 28 is rolled up along the first outer peripheral portion 154*b*. This makes it possible to ensure that the control wire 28 is displaced to an amount sufficient to cause a water discharge valve to be moved upwardly and opened.

Further, the rotary roll-up member 154 allows the first outer peripheral portion 154*b* configured to roll up the control wire 28 fixed to the fixing portion 154*e* and the second outer peripheral portion 154*d* having the roll-up member tooth portion 154*c* configured to be meshable with the first tooth portion 150*a* to be rotated about the same rotational center shaft. Thus, the first outer peripheral portion 154*b* and the second outer peripheral portion 154*d* can be formed on the same plane. This makes it possible to form the rotary roll-up member 154 to have a small thickness as compared to the case where the first outer peripheral portion 154*b* and the second outer peripheral portion 154*d* are not formed on the same plane, so that the size of the rotary roll-up member 154 itself can be decreased.

What is claimed is:

1. An operating device for a flush water tank assembly, which is designed to operate a water discharge valve disposed in a flush water tank to start supply of flush water to a toilet main unit, comprising:

an operating member disposed in a lateral region of an outer surface of the flush water tank, and configured to be rotationally moved according to a rotational operation performed by a user;

a rotary shaft for transmitting the rotational movement of the operating member to an inside of the flush water tank;

a drive unit disposed above a level of flush water within the flush water tank, and driven according to the rotational movement of the rotary shaft, a wire coupling the drive unit and the water discharge valve together, and capable of opening and closing the water discharge valve by means of its own displacement, wherein the drive unit comprises a rotation mechanism configured to be rotated at a radius of rotation greater than that of the rotary shaft, and the rotation mechanism comprises a rotary roll-up member, the rotary roll-up member being operable to roll up the wire along a pulley portion formed on an outer periphery of the rotary roll-up member by its own rotation.

2. The operating device according to claim 1, wherein the rotary roll-up member has a roll-up member tooth portion which is a part of another outer periphery thereof formed with external teeth, and a fixing portion fixing the wire while allowing the wire to extend along the outer periphery thereof, and wherein the rotation mechanism of the drive unit comprises:

a first rotary gear member attached to the rotary shaft in interlocking relation to the rotary shaft, and having a first tooth portion formed with external teeth; and a second rotary gear member having a second tooth portion formed with external teeth and meshable with each of the first tooth portion and the roll-up member tooth portion.

3. The operating device according to claim 2, wherein the rotary roll-up member is configured such that a rotational center shaft has an axis identical to that of the rotary shaft to which the first rotary gear member is attached.

4. The operating device according to claim 3, wherein the drive unit is configured to allow an arrangement of the second rotary gear member and the rotary roll-up member of the rotation mechanism to be changed, whereby the drive unit can be attached to the operating member, irrespective of whether the operating member is attached to a left lateral region or a right lateral region of the outer surface of the flush water tank.

5. The operating device according to claim 2, wherein the rotary roll-up member comprises:

a first outer peripheral portion at which the fixing portion is disposed and which is formed to have a relatively large curvature radius; and a second outer peripheral portion which forms the roll-up member tooth portion and which is formed to have a curvature radius smaller than that of the first outer peripheral portion.

6. The operating device according to claim 5, wherein the drive unit comprises a covering member covering the rotation mechanism, the covering member having a restricting portion formed thereinside, wherein the second rotary gear member is formed in a partial shape smaller than a semicircle, and wherein the drive unit is configured to allow a lateral surface of the partial shape and the restricting portion to come into contact with each other to thereby restrict a range in which a user is permitted to perform the rotational operation of the operating member.

7. The operating device according to claim 1, wherein the rotation mechanism of the drive unit comprises:

a first rotary gear member attached to the rotary shaft in interlocking relation to the rotary shaft, and having a first tooth portion formed with external teeth, wherein the rotary roll-up member has a roll-up member tooth portion which is a part of another outer periphery thereof formed with external teeth and meshable with the first rotary gear member, and a fixing portion fixing the wire while allowing the wire to extend along the outer periphery thereof.

8. The operating device according to claim 7, wherein the rotary roll-up member comprises:

a first outer peripheral portion at which the fixing portion is disposed and which is formed to have a relatively large curvature radius; and a second outer peripheral portion which forms the roll-up member tooth portion and which is formed to have a curvature radius smaller than that of the first outer peripheral portion.

9. A flush water tank assembly comprising:

a flush water tank storing flush water;

a flush water supply device supplying flush water into the flush water tank;

a water discharge valve disposed in the flush water tank to start supply of flush water to the toilet main unit; and the operating device according to claim 1.

10. A flush toilet comprising:

the flush water tank assembly according to claim 9; and the toilet main unit having a bowl portion and a drainage trap passage.

* * * * *